US010751852B2

(12) United States Patent
Hasegawa et al.

(10) Patent No.: US 10,751,852 B2
(45) Date of Patent: Aug. 25, 2020

(54) SURFACE GRINDING METHOD AND SURFACE GRINDING DEVICE

(71) Applicant: KOYO MACHINE INDUSTRIES CO., LTD., Osaka (JP)

(72) Inventors: Takahiro Hasegawa, Osaka (JP); Yoshihiro Kurioka, Osaka (JP); Kazuhiro Yuso, Osaka (JP)

(73) Assignee: KOYO MACHINE INDUSTRIES CO., LTD., Osaka (JP)

( * ) Notice: Subject to any disclaimer, the term of this patent is extended or adjusted under 35 U.S.C. 154(b) by 417 days.

(21) Appl. No.: 15/899,770

(22) Filed: Feb. 20, 2018

(65) Prior Publication Data

US 2018/0257195 A1 Sep. 13, 2018

(30) Foreign Application Priority Data

Mar. 13, 2017 (JP) ..... 2017-047149

(51) Int. Cl.
*B24B 49/18* (2006.01)
*B24B 7/22* (2006.01)
*B24B 53/02* (2012.01)

(52) U.S. Cl.
CPC ..... *B24B 49/186* (2013.01); *B24B 7/228* (2013.01); *B24B 53/02* (2013.01)

(58) Field of Classification Search
CPC ..... B24B 49/186; B24B 7/28; B24B 7/228; B24B 53/02
See application file for complete search history.

(56) References Cited

U.S. PATENT DOCUMENTS

| | | | | |
|---|---|---|---|---|
| 6,431,949 | B1 * | 8/2002 | Ishikawa | B24B 7/228 451/21 |
| 6,431,964 | B1 * | 8/2002 | Ishikawa | B24B 7/228 257/E21.23 |
| 7,238,087 | B1 * | 7/2007 | Kashiwa | B24B 7/228 451/287 |
| 2005/0176350 | A1 * | 8/2005 | Gerber | B24B 53/02 451/11 |
| 2006/0111021 | A1 * | 5/2006 | Gerber | B24B 53/02 451/11 |
| 2008/0090505 | A1 * | 4/2008 | Yoshida | B24B 1/00 451/413 |

FOREIGN PATENT DOCUMENTS

JP 2009-023057 A 2/2009

* cited by examiner

*Primary Examiner* — Dung Van Nguyen
(74) *Attorney, Agent, or Firm* — Studebaker & Brackett PC

(57) ABSTRACT

In a surface grinding method in which a grinding wheel is dressed with a dressing board on a chuck table by advancing the grinding wheel from a dressing start position and a workpiece on the chuck table is ground by advancing the grinding wheel, the dressing start position is calculated by measuring a thickness of the dressing board and a thickness of the grinding wheel, and the grinding start position is calculated by measuring the thickness of the grinding wheel after the dressing of the grinding wheel with the dressing board.

9 Claims, 16 Drawing Sheets

(CONT.)

(Fig. 10 Continued)
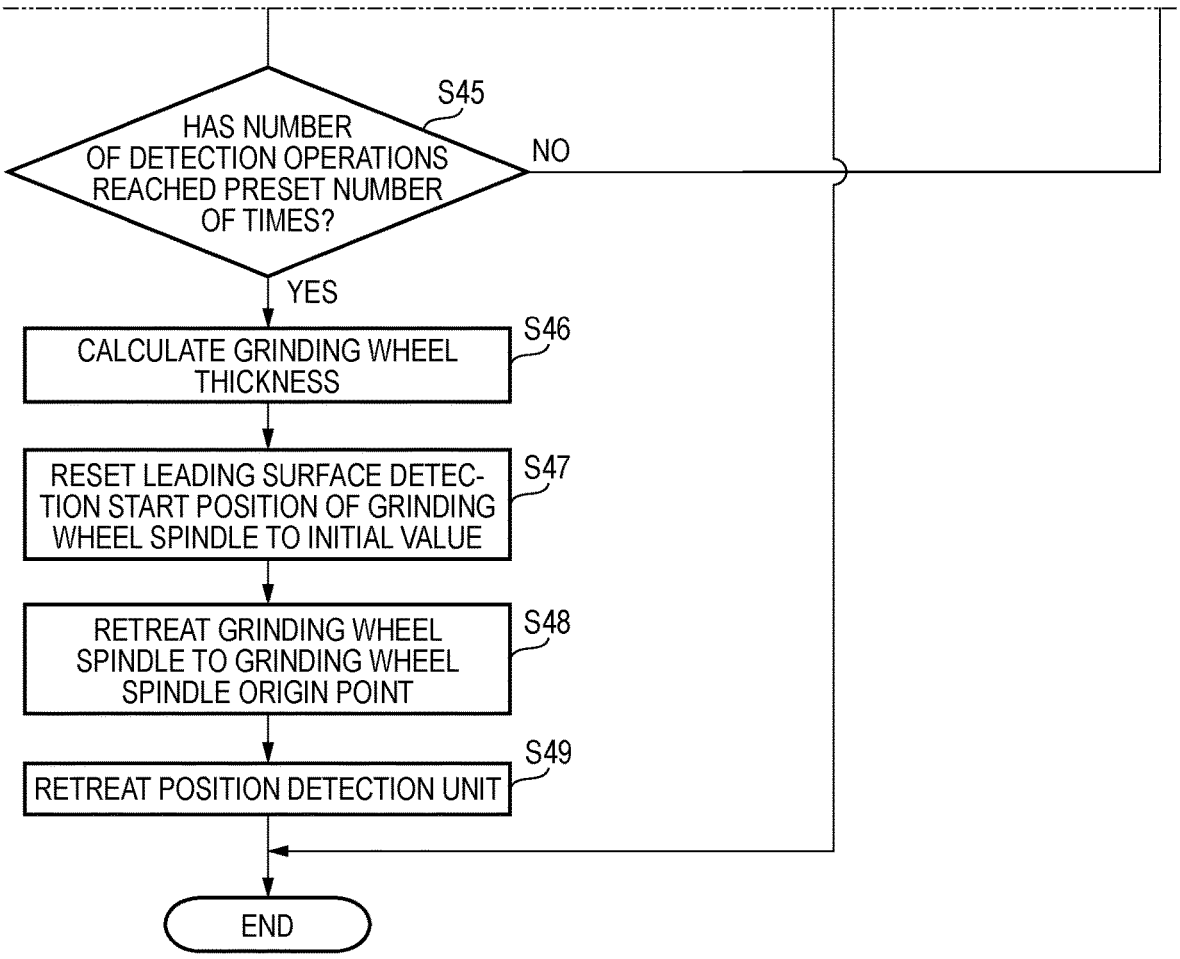

(CONT.)

(Fig. 15 Continued)
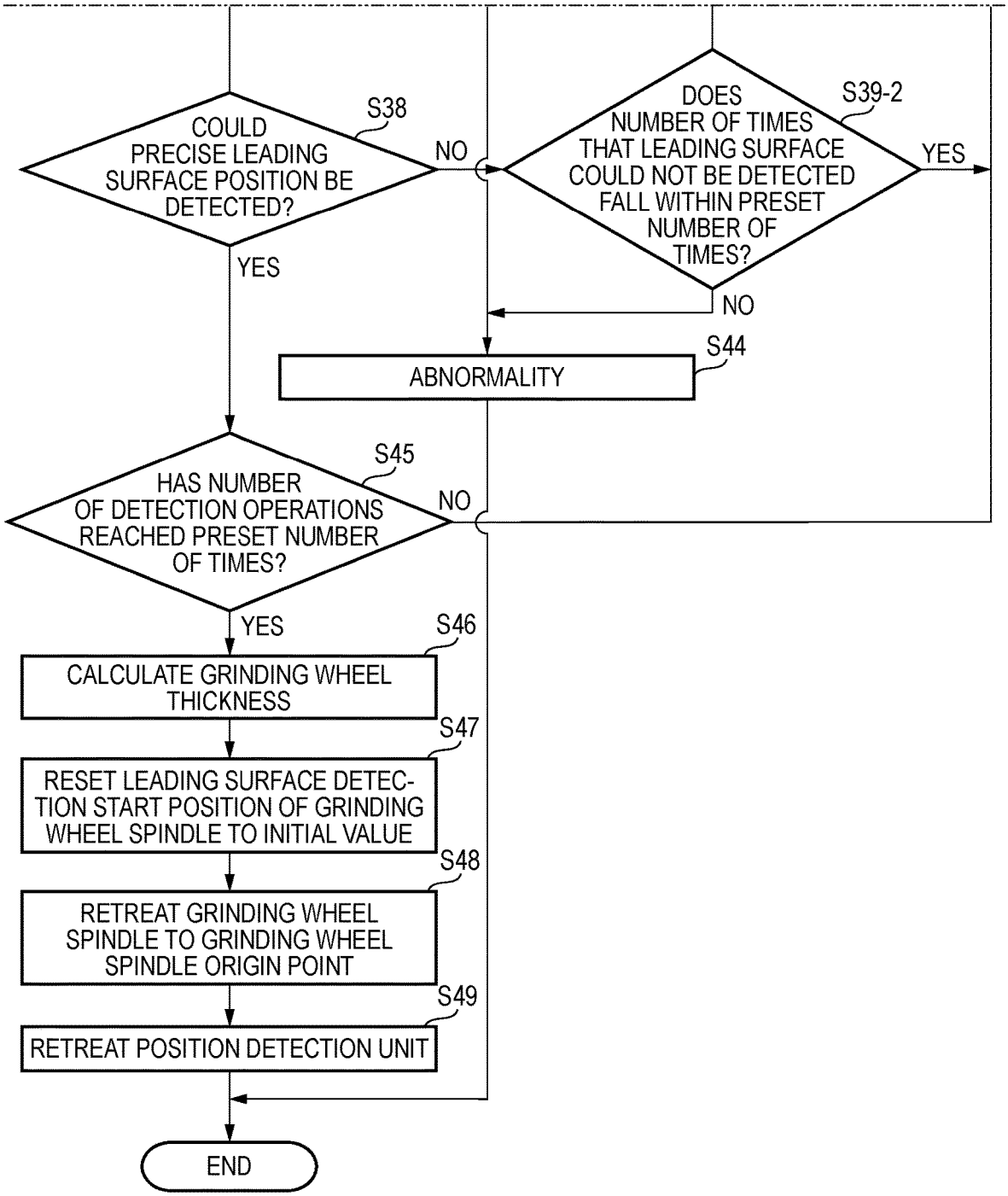

SURFACE GRINDING METHOD AND SURFACE GRINDING DEVICE

CROSS-REFERENCES TO RELATED APPLICATION(S)

This application is based on and claims priority from Japanese Patent Application No. 2017-047149 filed on Mar. 13, 2017, the entire contents of which are incorporated herein by reference.

BACKGROUND

1. Field of the Invention

The present invention relates to a surface grinding method and a surface grinding machine for grinding a workpiece.

2. Description of Related Art

In a surface grinding process of grinding a thin disk-shaped workpiece such as a semiconductor substrate, when grinding a workpiece made of a material which cannot expect a self-sharpening of a grinding wheel, the grinding wheel causes dulling or clogging with a progress of the processing. Therefore, in order to maintain grinding precision, the grinding wheel should be frequently dressed to maintain the sharpness of the grinding wheel.

According to the related art, in order to dress a leading surface of a grinding wheel, a dressing board is mounted on a chuck table (for example, see JP-A-2009-023057).

That is, in order to perform a dressing, the dressing board is mounted on the chuck table, a predetermined dressing condition is selected and set, a grinding wheel spindle is advanced while the dressing board is rotated by the chuck table and the grinding wheel is rotated by the grinding wheel spindle, and the leading surface of the grinding wheel is dressed with the dressing board through relative rotation between the dressing board and the chuck table.

At this time, a probe of a reference height gauge of a thickness measuring gauge is brought in contact with a top surface of the chuck table and a probe of movable height gauge is brought in contact with a top surface of a dressing grinding stone part, in order to measure a thickness of the dressing board. When the dressing of the grinding wheel is finished, a leading surface position of the grinding wheel is acquired from the thickness of the dressing board at this time. Then, the position is set as an origin position.

According to the related art, a dressing cycle is started immediately after the predetermined dressing condition is selected and set, without measuring the thickness of the dressing board. Therefore, the dressing board and the grinding wheel may be excessively worn.

Moreover, during the dressing process, the probes of the thickness measuring gauge are brought in contact with the chuck table and the dressing grinding stone part, which are being rotated, and the leading surface position of the grinding wheel is determined by the measurement value. Therefore, the thickness of the dressing board is difficult to correctly measure, and easily affected by a coolant or the like, and the origin point is difficult to correctly and reliably determined.

SUMMARY

In accordance with embodiments, a surface grinding method and machine are capable of efficiently dressing a grinding wheel through a dressing board and automatically calculating a dressing start position and a grinding start position.

According to embodiments, in a surface grinding method in which a grinding wheel is dressed with a dressing board on a chuck table by advancing the grinding wheel from a dressing start position and a workpiece on the chuck table is ground by advancing the grinding wheel, the dressing start position is calculated by measuring a thickness of the dressing board and a thickness of the grinding wheel, and the grinding start position is calculated by measuring the thickness of the grinding wheel after the dressing of the grinding wheel with the dressing board.

According to embodiments, in a surface grinding machine, a grinding wheel mounted on a grinding wheel mounting surface of a grinding wheel spindle is dressed with a dressing board on a chuck table by advancing the grinding wheel from a dressing start position, and a workpiece on the chuck table is ground by advancing the grinding wheel from a grinding start position. The surface grinding machine includes: a dressing board placing table on which the dressing board is placed; a height measuring unit configured to measure a height of a top surface of the dressing board placing table and a height of a top surface of the dressing board on the dressing board placing table; a position detection unit configured to detect a position of the grinding wheel mounting surface and a position of a leading surface of the grinding wheel; a dressing start position calculation unit configured to calculate the dressing start position based on the height of the top surface of the dressing board placing table and the height of the top surface of the dressing board; and a grinding start position calculation unit configured to calculate the grinding start position based on the position of the grinding wheel mounting surface and the position of the leading surface of the grinding wheel.

Other aspects and advantages of the invention will be apparent from the following description and the appended claims.

DETAILED DESCRIPTION

Hereafter, exemplary embodiments will be described with reference to the drawings.

Figure 1:
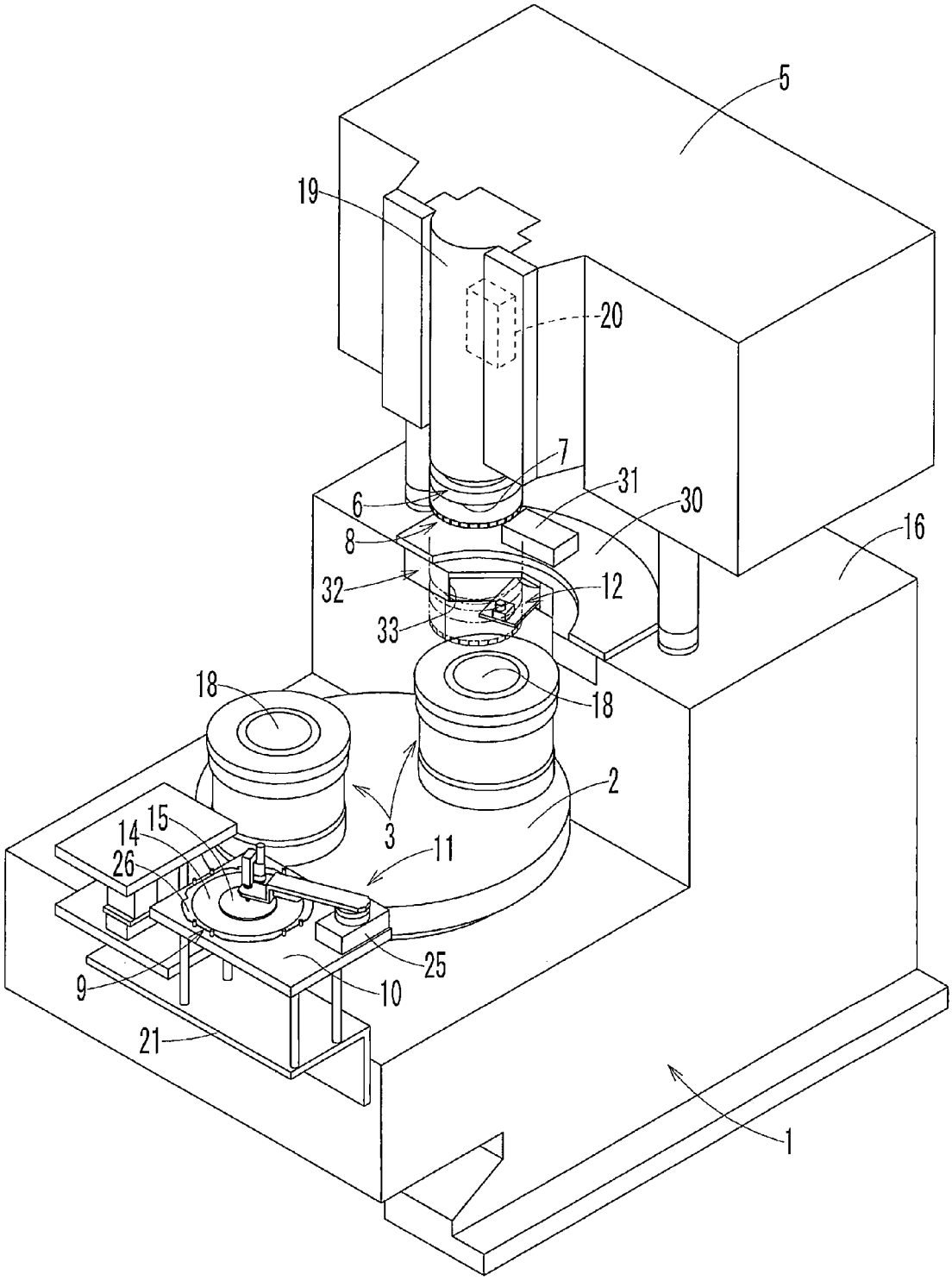
FIG. 1 is a perspective view of a surface grinding machine according to a first embodiment.

FIGS. 1 to 14 illustrate a first embodiment. FIG. 1 is a perspective view of an ultra-precision vertical surface grinding machine, FIG. 2 is a front view of main parts of the surface grinding machine, and FIG. 3 is a plan view of the main parts of the surface grinding machine.

Figure 2:
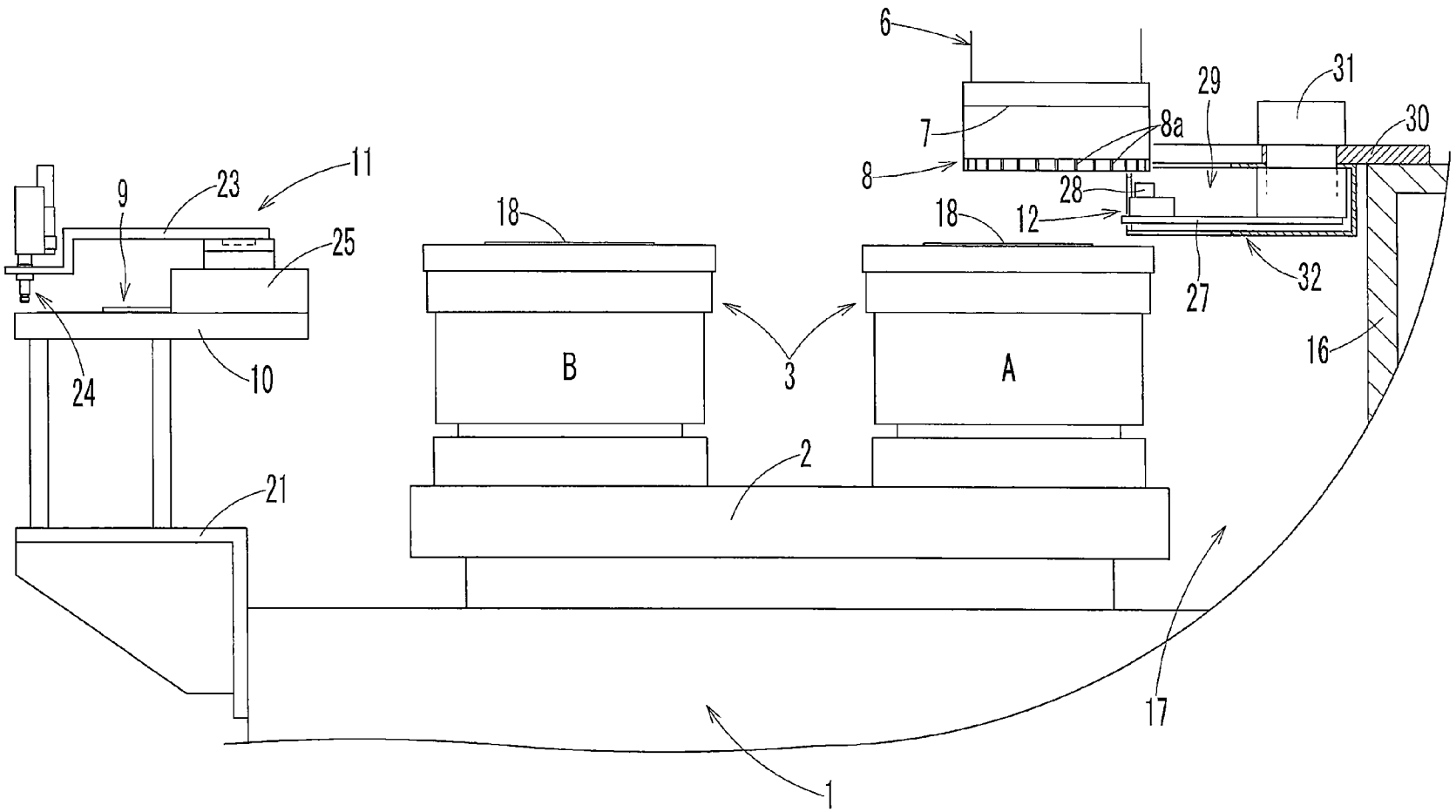
FIG. 2 is a front view of main parts of the surface grinding machine.
Figure 3:
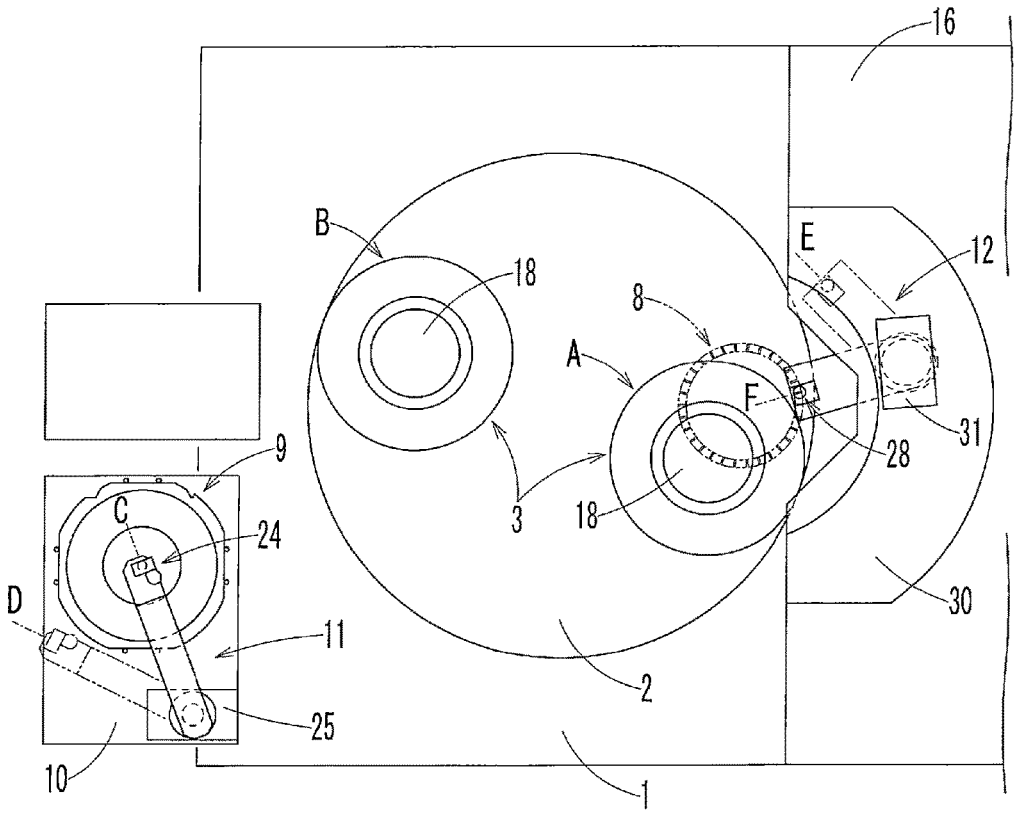
FIG. 3 is a plan view of main parts of the surface grinding machine.

As illustrated in FIGS. 1 to 3, the surface grinding machine includes a bed 1, a turn table 2 turnably disposed on the bed 1, two chuck tables 3 disposed at equally divided positions on the turn table 2, a support frame 5 disposed on the bed 1, a grinding wheel spindle 6 mounted in the support frame 5 at the turn table 2 so as to move upward/downward, a grinding wheel 8 detachably mounted on a grinding wheel mounting surface 7 formed at a leading end of the grinding wheel spindle 6, a dressing board placing table 10 having a dressing board 9 placed thereon, a height measuring unit 11 for measuring the heights of the top surfaces of the dressing board placing table 10 and the dressing board 9, a position detection unit 12 for detecting a position of the grinding wheel mounting surface 7 of the grinding wheel spindle 6 and a position of a leading surface of the grinding wheel 8 at an leading end thereof, and a loader (refer to FIGS. 7A to 7C) for loading/unloading the dressing board 9 and a workpiece.

As illustrated in FIGS. 1 and 7, the dressing board 9 includes a ring-shaped dicing frame 26, a sheet member 14 bonded to a lower side of the dicing frame 26, and a dressing grinding stone part 15 concentrically bonded onto the sheet member 14 with a predetermined space provided between the dicing frame 26 and the dressing grinding stone part 15. The workpiece is a thin plate material such as a semiconductor wafer, but may include other materials.

The bed 1 has a stepped part 16 formed under the support frame 5, and the support frame 5 is disposed on the stepped part 16. The stepped part 16 has a concave portion 17 provided at the turn table 2, and substantially the central portion of the concave portion 17 is set to a grinding position A. The chuck table 3 has a chuck surface 18 formed at the top surface thereof, the chuck surface 18 capable of vacuum suctioning the dressing board 9 and the workpiece. The chuck table 3 can be rotated around a vertical axis on the turn table 2 by a driving source such as a driving motor (not illustrated). The turn table 2 can be turned around a turning shaft on the bed 1 by the driving source such as a driving motor (not illustrated) such that the chuck tables 3 are selectively located at the grinding position A and a loading/unloading position B.

The grinding wheel spindle 6 is supported by a movable bearing box 19 so as to rotate around a vertical axis, and rotated around the vertical axis by a driving source such as a servo motor or pulse motor (not illustrated). The movable bearing box 19 is movably supported by the support frame 5 above the grinding position A, and can be moved upward and downward by a driving source such as a driving motor through a feeding mechanism such as a ball screw incorporated in the support frame 5. The raise of the movable bearing box 19 is limited to the origin position O of the upper limit. An elevating unit for elevating the movable bearing box 19 with respect to the support frame 5 is provided with a feeding amount measuring unit 20 for measuring a downward feeding amount from the origin position O of the grinding wheel spindle 6.

The grinding wheel 8 includes a plurality of segments 8*a* arranged in a ring shape in a circumferential direction (refer to FIGS. 9A to 9F). The grinding wheel 8 is disposed eccentrically with the chuck table 3 at the grinding position A, such that the segments 8*a* arranged in a ring-shape pass through the centers of the dressing board 9 and the workpiece on the chuck table 3 at the grinding position A.

The dressing board placing table 10 can load the dressing board 9 on the top surface thereof. The dressing board placing table 10 is disposed at the opposite side of the grinding wheel spindle 6 with respect to the turn table 2, and provided through a mounting frame 21 of the bed 1. The dressing board placing table 10 includes a plurality of positioning pins and other positioning parts 22 provided on the outer circumference of the dressing board 9, and the plurality of positioning pins and positioning parts 22 are used to position the dressing board 9 at a predetermined loading location.

Figure 7A:
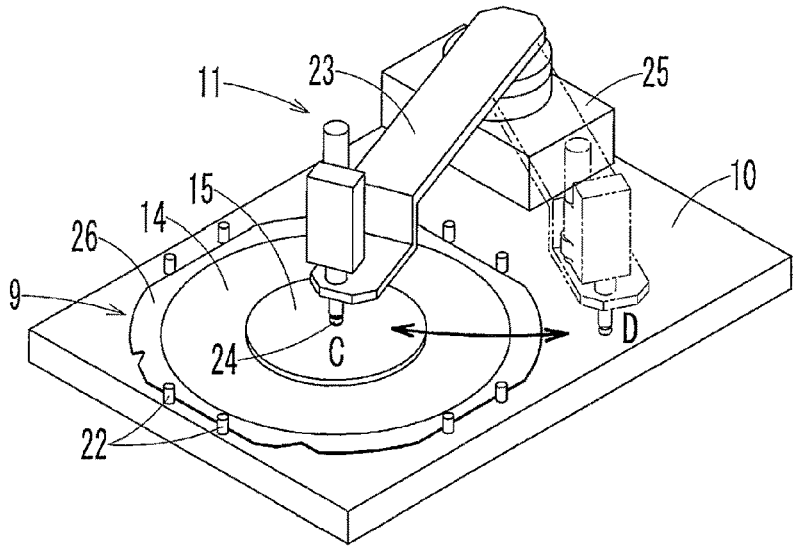
FIGS. 7A to 7C illustrate a measurement order of a dressing board thickness in the surface grinding machine.
Figure 7B:
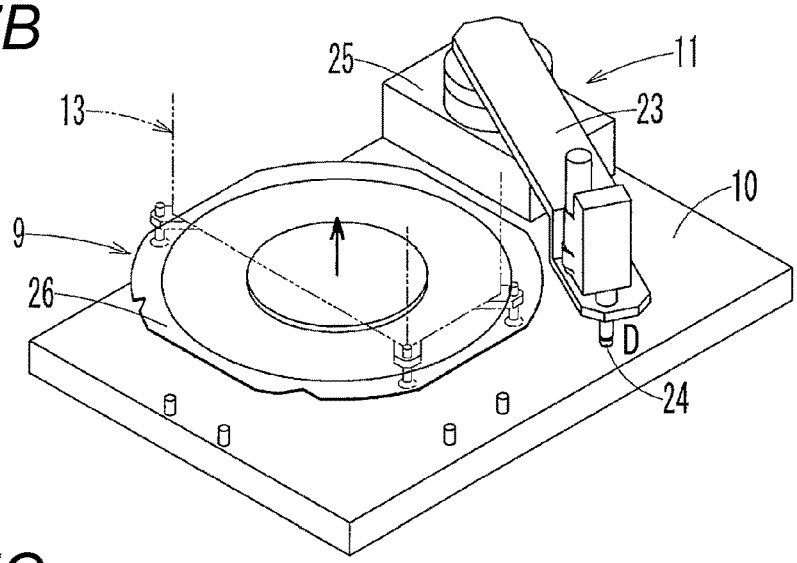
Figure 7C:
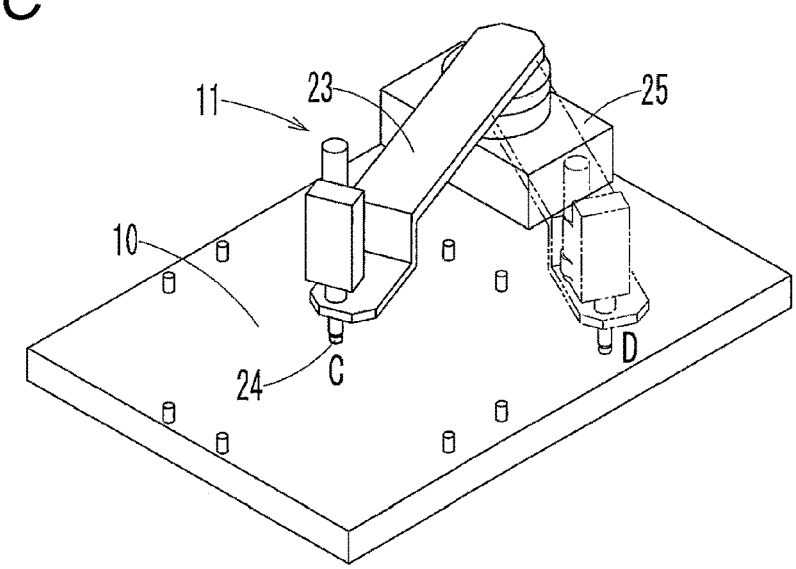

As illustrated in FIGS. 7A to 7C, the height measuring unit 11 includes a turning arm 23 which turns around a vertical axis parallel to the grinding wheel spindle 6 and a contact-type linear gauge 24 which protrudes downward from the leading end of the turning arm 23 so as to move upward and downward and has a cylinder incorporated therein. The height measuring unit 11 brings the leading end of the linear gauge 24 in contact with the top surfaces of the dressing board placing table 10 and the dressing board 9, and measures the heights of the top surfaces.

The turning arm 23 can be turned around the vertical axis between a measurement position and a retreat position D in FIGS. 3 and 7 by a turn driving unit 25 such as a turning cylinder fixed on the dressing board placing table 10.

As illustrated in FIGS. 9A to 9F, the position detection unit 12 includes a turning arm 27 which is turned around a vertical axis parallel to the grinding wheel spindle 6 and a touch sensor 28 protruding upward from the leading end of the turning arm 27. The position detection unit 12 brings the touch sensor 28 in contact with the grinding wheel mounting surface 7 at the leading end of the grinding wheel spindle 6 and the leading surface of the grinding wheel 8 at the leading end thereof, and detects the positions of the grinding wheel spindle 6 and the grinding wheel 8.

When the touch sensor 28 of the position detection unit 12 detects the grinding wheel mounting surface 7 of the grinding wheel spindle 6 and the leading surface of the grinding wheel 8 in order to detect a grinding wheel mounting surface position J (refer to FIG. 5) of the grinding wheel spindle 6 and the leading surface position of the grinding wheel 8, a feeding amount of the feeding amount measuring unit 20 is acquired as the grinding wheel mounting surface position J of the grinding wheel spindle 6 and the leading surface position of the grinding wheel 8.

The turning arm 27 is disposed in a housing chamber 29 provided in the concave portion 17 of the stepped part 16 of the bed 1, and can be turned around the vertical axis between a housing position E of the housing chamber 29 and a detection position F at the grinding position A by a turn driving unit 31 such as a turning cylinder fixed to a support plate 30.

The housing chamber 29 is provided in a housing cover 32 including the support plate 30 fixed to the stepped part 16 of the bed 1 at the concave portion 17. The housing cover 32 covers the position detection unit 12, and the position detection unit 12 can be advanced and retreated through an opening 33 of the housing cover 32. The turning arm 27 may be provided with a lid plate that blocks the opening 33 when the position detection unit 12 is located at the housing position E.

The loader 13 suctions the dressing board 9 and the workpiece through vacuum suction, and loads/unloads the dressing board 9 and the workpiece onto/from the chuck table 3 at the loading/unloading position B.

Figure 4:
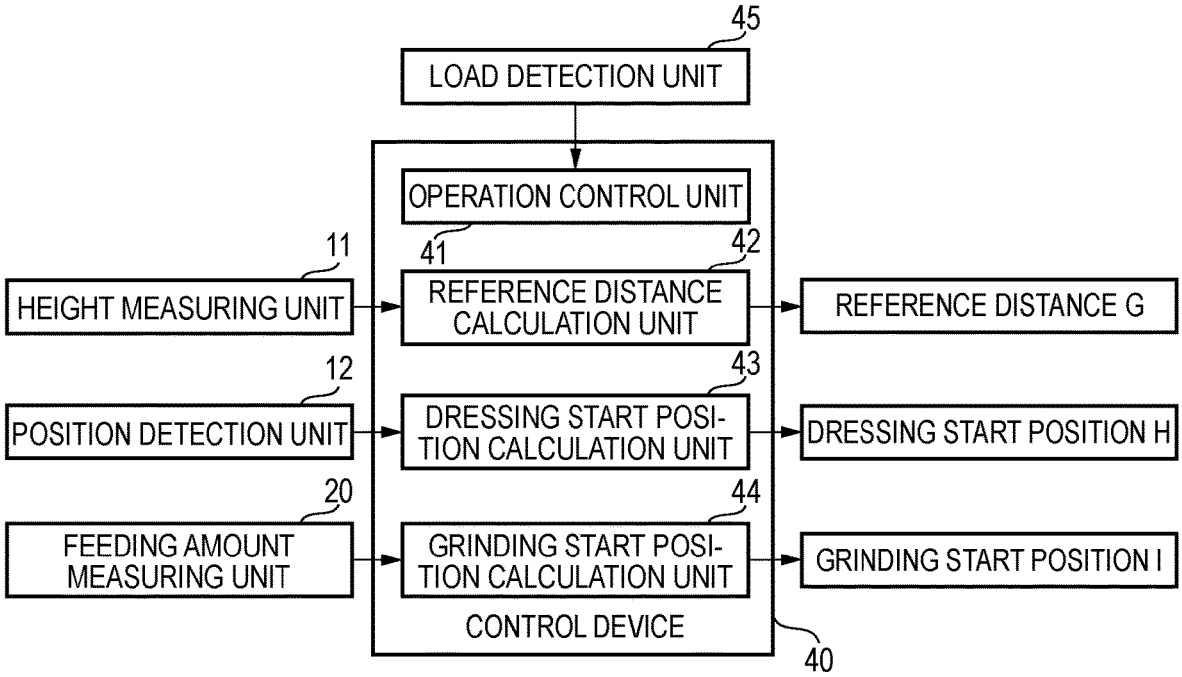
FIG. 4 is a block diagram of a control device of the surface grinding machine.

The surface grinding machine is provided with a control device 40 having a configuration illustrated in FIG. 4. The control device 40 includes an operation control unit 41 for controlling a manual operation and automatic operation, a reference distance calculation unit 42 for calculating a reference distance G (refer to FIG. 5), a dressing start position calculation unit 43 for calculating a dressing start position H (refer to FIG. 5), and a grinding start position calculation unit 44 for calculating a grinding start position I (refer to FIG. 5).

The operation control unit 41 automatically controls an operation of loading/unloading the dressing board 9 and the workpiece through the loader, an operation of turning and stopping the turn table 2, an operation of dressing the grinding wheel 8 through the dressing board 9, an operation of grinding the workpiece through the grinding wheel 8, an operation of detecting the heights of the dressing board 9 and the dressing board placing table 10 through the height measuring unit 11, and the operation of detecting the positions of the grinding wheel mounting surface 7 of the grinding wheel spindle 6 and the leading surface of the grinding wheel 8 through the position detection unit 12. Furthermore, the operation control unit 41 controls a dressing operation in a load sensing dressing cycle, when a load sensing unit 45 senses a dressing load during an operation of dressing the grinding wheel 8.

The load sensing unit 45 serves to sense a dressing load when the dressing board 9 is brought in contact with the grinding wheel 8. While the grinding wheel spindle 6 is advanced, the load sensing unit 45 senses a dressing load through a torque variation of the driving motor when the dressing board 9 is brought in contact with the grinding wheel 8.

The reference distance calculation unit 42 serves to calculate the reference distance G as a calculation reference value for the dressing start position H and the grinding start position I. The reference distance calculation unit 42 calculates the reference distance G from the grinding wheel mounting surface 7 to the chuck surface 18 of the chuck table 3 when the grinding wheel spindle 6 is retreated to the origin position O, based on a grinding wheel mounting surface position J of the grinding wheel spindle 6 at the origin position O, a self grinding feeding amount from a self grinding start position K to a self grinding finish position L, and the leading surface position of a self grinding wheel 8A after self grinding. The calculating of the reference distance G is performed during self grinding on the chuck surface 18.

The dressing start position calculation unit 43 serves to calculate the dressing start position H during a dressing operation with the dressing board 9, using the reference distance G calculated by the reference distance calculation unit 42. The dressing start position calculation unit 43 can subtract a grinding wheel thickness, a dressing board thickness and a preset dressing feeding amount (including dressing amount) from the reference distance G, and calculate the dressing start position H at which the grinding wheel mounting surface 7 of the grinding wheel spindle 6 is positioned when dressing is started. The dressing amount corresponds to a difference in the grinding wheel thickness and the dressing board thickness between before and after dressing.

The grinding start position calculation unit 44 serves to calculate the grinding start position I during a grinding operation by the grinding wheel 8, using the reference distance G calculated by the reference distance calculation unit 42. The grinding start position calculation unit 44 subtracts the grinding wheel thickness of the grinding wheel 8 mounted on the grinding wheel spindle 6, the thickness or finish thickness of a set master workpiece 35, and a grinding feeding amount from the reference distance G, and calculates the grinding start position I at which the grinding wheel mounting surface 7 of the grinding wheel spindle 6 is positioned when grinding is started.

In the surface grinding machine, the dressing board 9 is suctioned to the chuck surface 18 of the chuck table 3, the chuck table 3 is moved to the grinding position A, and the grinding wheel 8 mounted on the grinding wheel spindle 6 is automatically dressed with the dressing board 9 on the chuck table 3 at the grinding position A.

When the series of automatic operations from the operation of dressing the grinding wheel 8 through the dressing board 9 to the operation of grinding the workpiece through the grinding wheel 8 are started, the detection of the leading surface position of the grinding wheel 8 and the measurement of the thickness of the dressing board 9 on the dressing board placing table 10 are automatically performed, and the dressing start position H and the grinding start position I are automatically determined and updated. Accordingly, a dressing position-adjustment operation and grinding position-adjustment operation which had been performed by an operator can be fully automated, and a continuous operation without an operator can be achieved.

Figure 6:
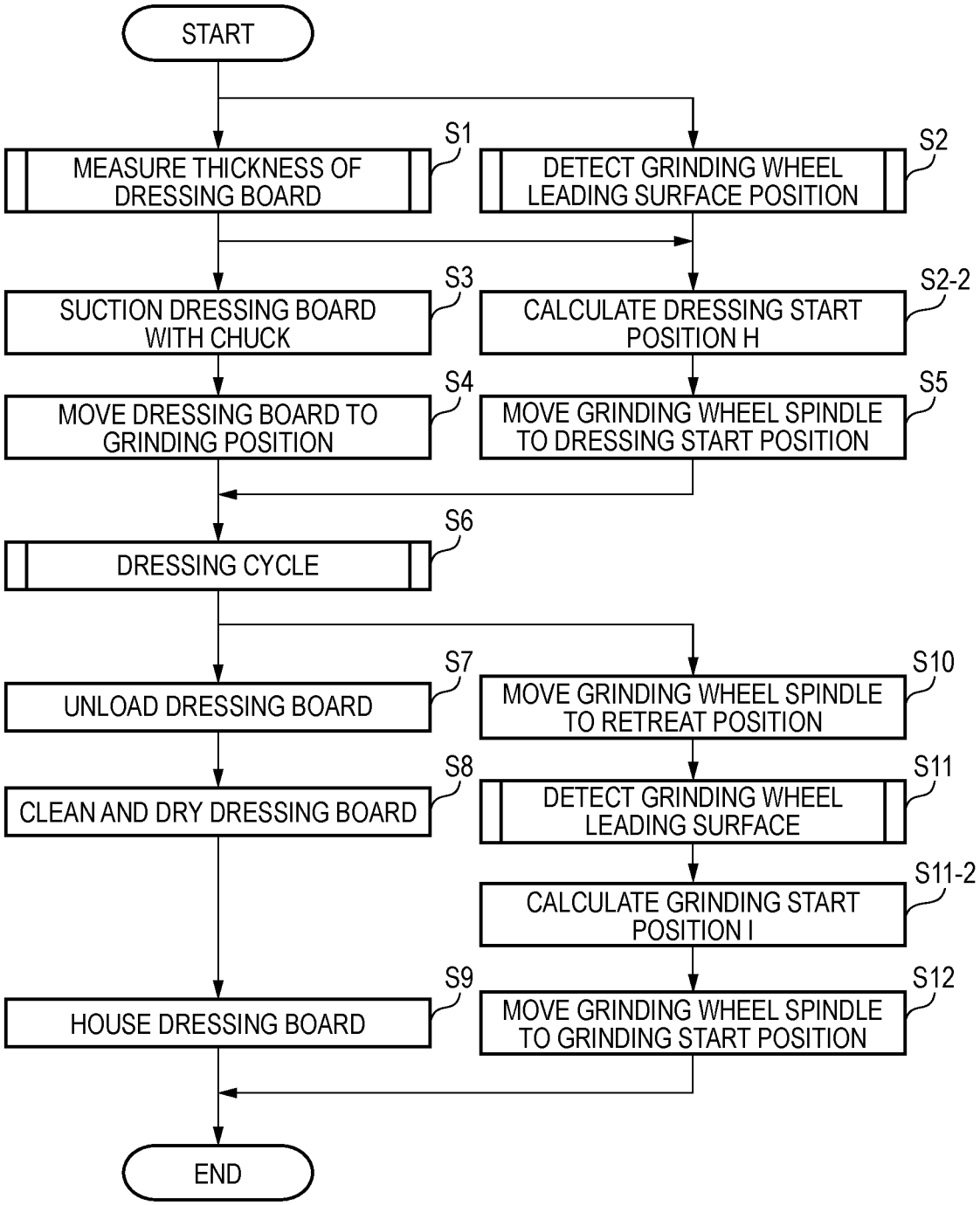
FIG. 6 is a flowchart illustrating an operation of the surface grinding machine.

FIG. 6 is a flowchart schematically illustrating an operation of the surface grinding machine. The surface grinding machine automatically operates through steps of the flowchart of FIG. 6, when the dressing start position H and the grinding start position I are set.

First, the height measuring unit 11 measures the thickness of the dressing board 9 on the dressing board placing table 10 (dressing board thickness measurement step S1), and the position detection unit 12 detects the leading surface position of the grinding wheel 8 at the leading end of the grinding wheel spindle 6 (grinding wheel leading surface position detection step S2) in parallel to the dressing board thickness measurement step S1. Then, the dressing board 9 after thickness measurement is suctioned by the chuck of the loader 13 (S3), loaded onto the chuck table 3 at the loading/unloading position B on the turn table 2, and moved to the grinding position A by a turn of the turn table 2 (S4). Then, the dressing start position calculation unit 43 calculates the dressing start position H (S2-2) through the dressing board thickness measurement and the detection of the leading surface of the grinding wheel (S1 and S2), and determines the dressing start position H (dressing start position decision step).

The grinding wheel spindle 6 is moved so that the grinding wheel mounting surface 7 of the grinding wheel spindle 6 is positioned at the dressing start position H (S5), and a dressing cycle is performed (S6). The dressing cycle includes advancing the grinding wheel spindle 6 from the dressing start position H while rotating the grinding wheel spindle 6 and the grinding wheel 8 in one direction and rotating the chuck table 3 in the reverse direction, such that the leading end surface of the grinding wheel 8 is dressed with the dressing board 9.

At this time, the dressing of the grinding wheel 8 with the dressing board 9 is performed by a load sensing dressing cycle of performing dressing while sensing a load change as described later. The grinding wheel 8 and the chuck table 3 may be rotated not only in the reverse directions, but also in the same direction.

When the dressing cycle is finished, the turn table 2 is turned to move the chuck table 3 to the loading/unloading position B, and the dressing board 9 on the chuck table 3 is unloaded by the loader 13 (S7). Then, the dressing board 9 is cleaned and dried (S8), and housed in the predetermined housing chamber 29 (S9).

The grinding wheel spindle 6 is retreated upward (S10), and the leading surface position of the grinding wheel 8 is detected by the position detection unit 12 (S11). Then, when the position detection unit 12 detects the leading surface position of the grinding wheel 8, the grinding start position calculation unit 44 calculates the grinding start position I (S11-2), and determines the grinding start position I (grinding start position decision step).

The grinding wheel spindle 6 is moved to the grinding start position I such that the grinding wheel mounting surface 7 of the grinding wheel spindle 6 is positioned at the grinding start position I in order to prepare for a grinding operation for a workpiece (S12). Then, the workpiece is automatically ground. When the dressing cycle is finished and the detecting of the leading surface position of the grinding wheel 8 is finished, the dressing start position H and the grinding start position I of a memory of the operation control unit 41 are automatically updated.

When such a method is adopted, an position-adjustment operation for the dressing start position H and an position-adjustment operation for the grinding start position I, which had been manually performed by an operator, do not need to be performed. Therefore, an operator may just change the grinding wheel 8, and a damage of the grinding wheel 8 or the equipment by an operation mistake of the operator and other human errors can be prevented, which makes it possible to significantly improve the operation efficiency.

Since operations affected by the skill of an operator can be automated, the operation efficiency can be uniformized. Furthermore, the wear amounts of the grinding wheel 8 and the dressing board 9 can be regularly monitored, and the changing times of the grinding wheel 8 and the dressing board 9 can be correctly identified and managed.

Figure 8:
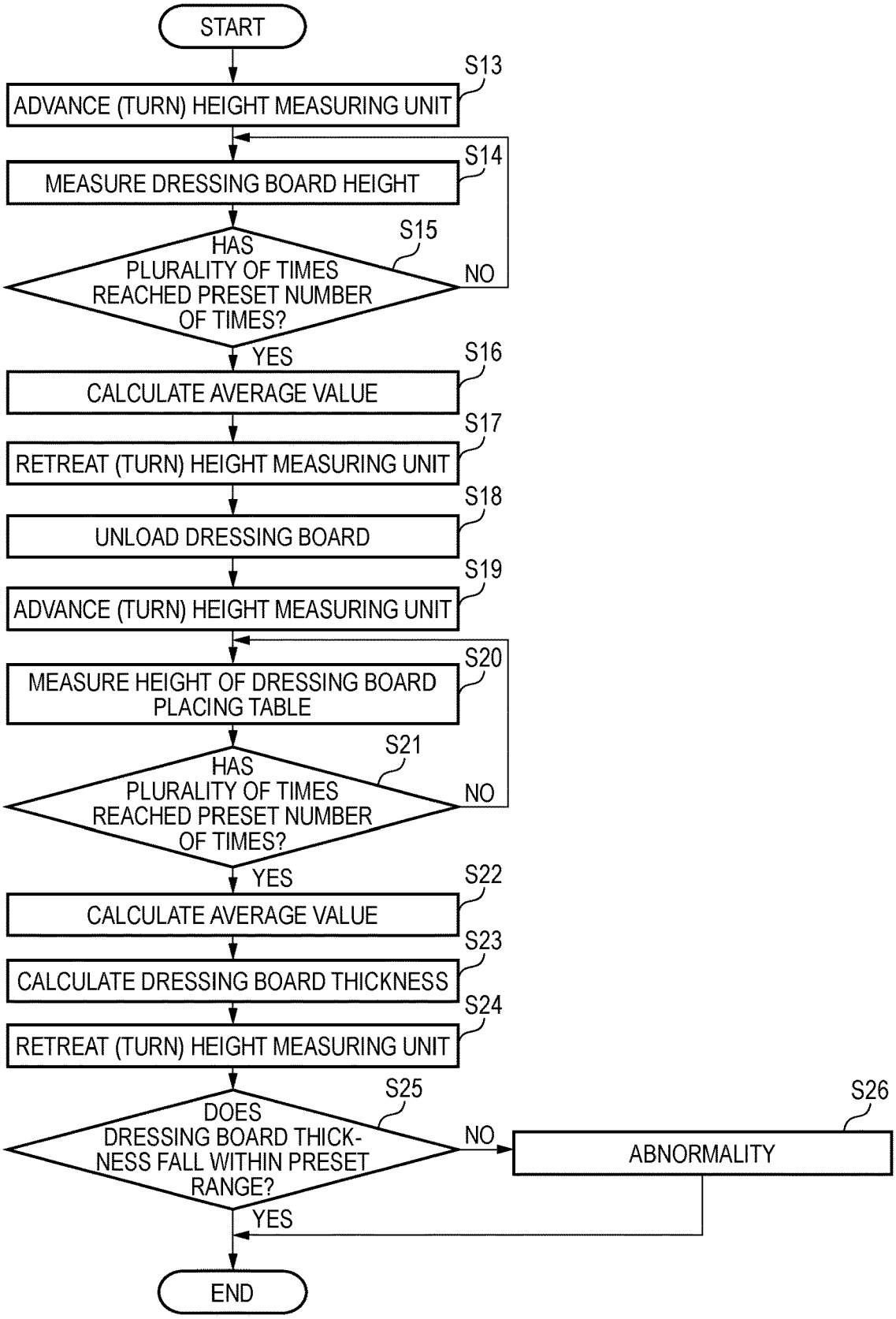
FIG. 8 is a flowchart illustrating the measuring of the dressing board thickness in the surface grinding machine.

The operation of measuring the thickness of the dressing board 9 is performed through steps of the flowchart of FIG. 8 while the height measuring unit 11 is operated as illustrated in FIGS. 7A to 7C. First, as illustrated in FIG. 7A, the dressing board 9 is set on the dressing board placing table 10, and the height measuring unit 11 is advanced and turned from the retreat position D to the measurement position C (S13). Then, the thickness of the central portion of the dressing grinding stone part 15 of the dressing board 9 is measured by the linear gauge 24 of the height measuring unit 11 (S14). The measuring of the top-surface height of the dressing board 9 is repeated a plurality of times while the linear gauge 24 is moved upward and downward, until the plurality of times reaches a preset number of times (S15). When the plurality of times reaches the preset number of times, the average value of the measured heights is calculated and set to the top-surface height of the dressing board 9 (S16).

As illustrated in FIG. 7B, the height measuring unit 11 is retreated to the retreat position D (S17), and the dressing board 9 on the dressing board placing table 10 is suctioned and unloaded by the loader 13 (S18). When the dressing board 9 on the dressing board placing table 10 is unloaded, the height measuring unit 11 is retreated to the measurement position C (S19) as illustrated in FIG. 7C, and measures the height of the dressing board placing table 10 while the linear gauge 24 is moved upward and downward (S20). The measuring of the height of the dressing board placing table is also performed a plurality of times (S21), and the average value of the measured heights is calculated and set to the top-surface height of the dressing board placing table 10 (S22).

When the top-surface heights of the dressing board 9 and the dressing board placing table 10 are set, the thickness of the dressing board 9 is calculated by subtracting the top-surface height of the dressing board placing table 10 from the top-surface height of the dressing board (S23). Then, the height measuring unit 11 is retreated to the retreat position D (S24), and determines whether the thickness of the dressing board 9 falls within a preset range (S25). When the thickness falls within the preset range, the procedure is finished. Otherwise, when the thickness does not fall within the preset range, an abnormality is notified (S26), and the procedure is finished. When the abnormality occurs, the setting values are changed to perform the measuring process again.

Figure 9A:
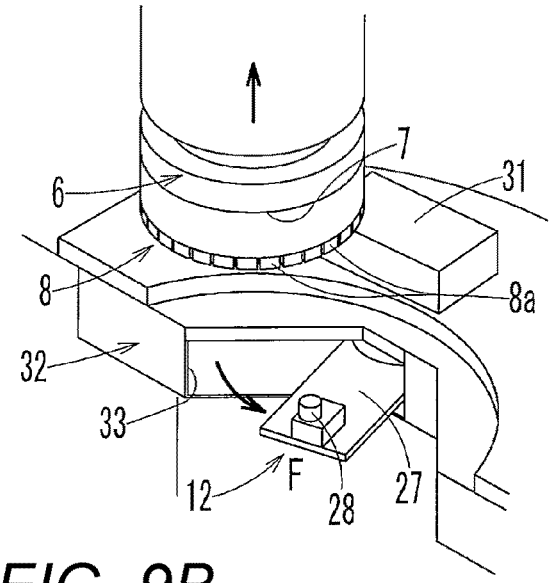
FIGS. 9A to 9F illustrate a grinding order of a leading surface position of a grinding wheel in the surface grinding machine.
Figure 9B:
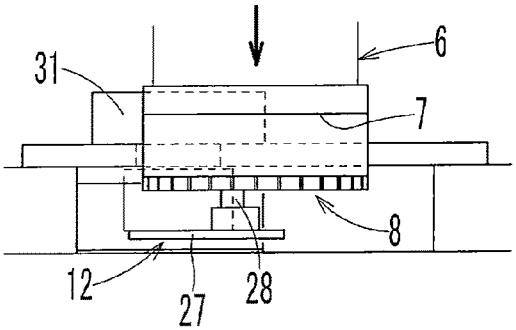
Figure 9C:
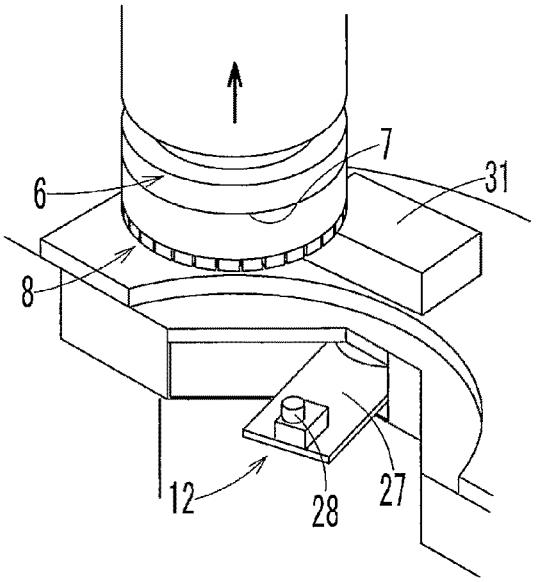
Figure 9D:
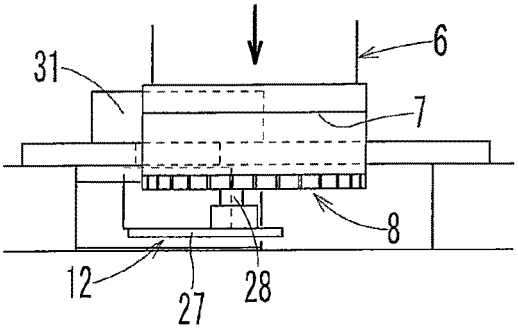
Figure 9E:
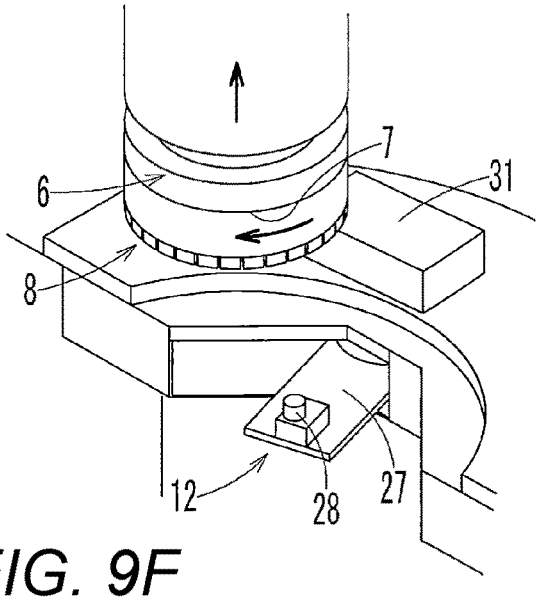
Figure 9F:
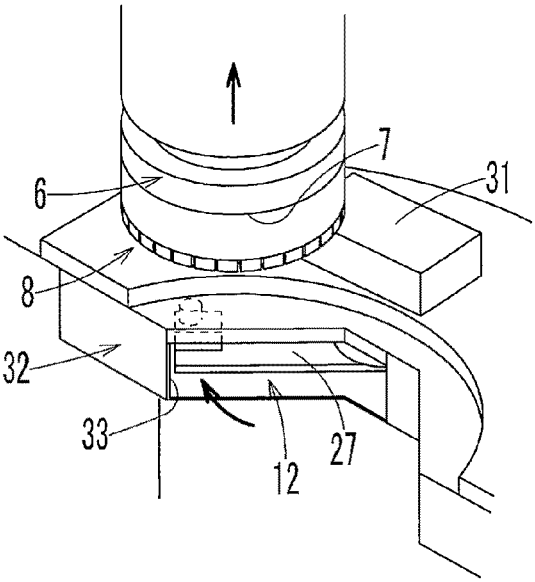
Figure 10:
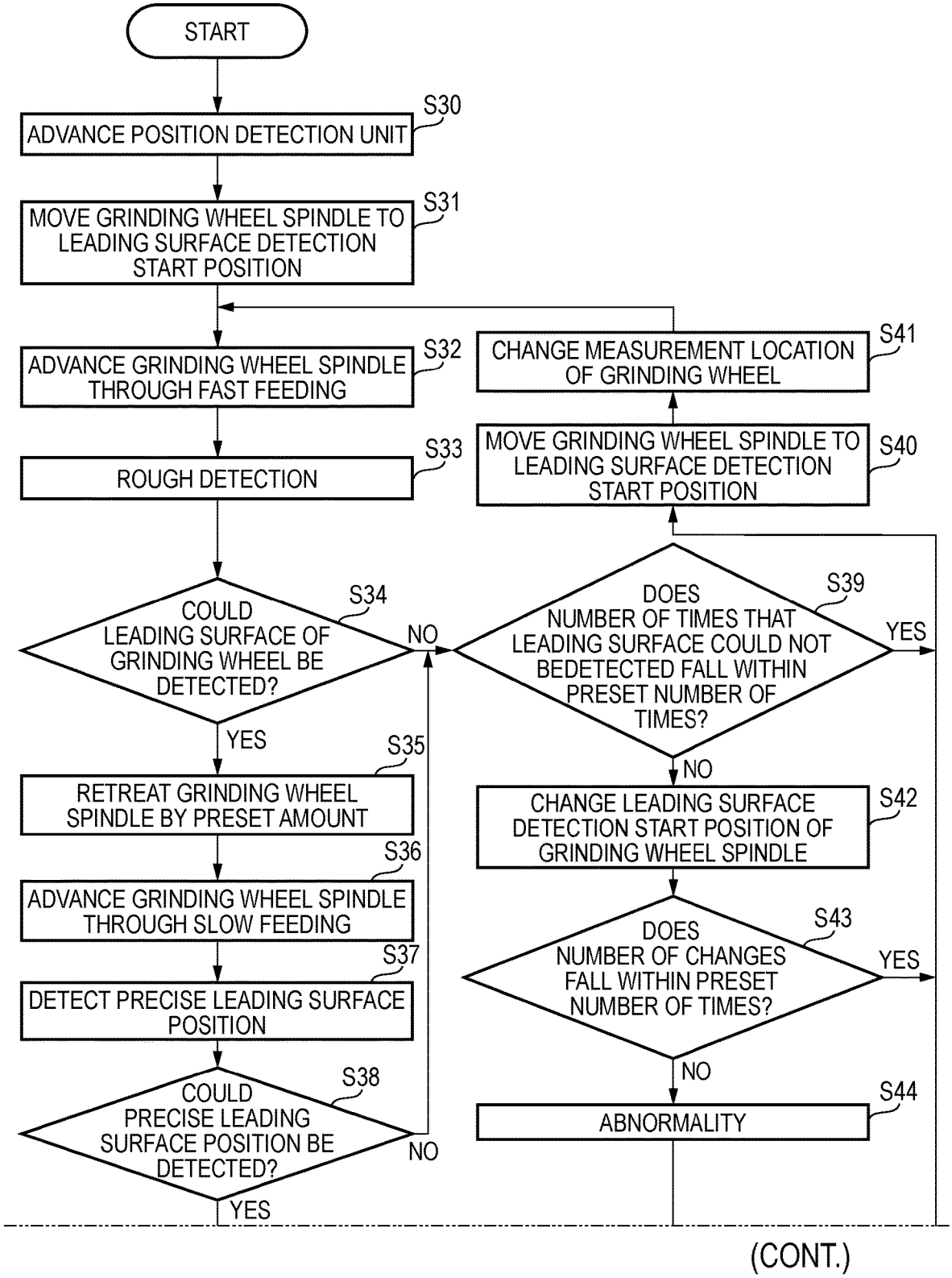
FIG. 10 is a flowchart illustrating leading surface position detection of the grinding wheel in the surface grinding machine.

The operation of measuring the leading surface position of the grinding wheel 8 is performed through steps of a flowchart illustrated in FIG. 10, while the position detection unit 12 is operated as illustrated in FIGS. 9A to 9F. First, as illustrated in FIG. 9A, the grinding wheel spindle 6 is retreated to a position at which the position detection unit 12 and the grinding wheel 8 do not interfere with each other (for example, grinding wheel spindle origin point), and the position detection unit 12 is advanced to the detection position F from the housing position E (S30). Accordingly, the touch sensor 28 of the position detection unit 12 corresponds to a leading end side of the segments 8*a* of the grinding wheel 8.

The grinding wheel spindle 6 is moved to the leading surface detection start position (S31), and advanced from the leading surface detection start position through fast-feeding (S32). Then, as illustrated in FIG. 9B, the touch sensor 28 of the position detection unit 12 is brought in contact with the leading surface of the grinding wheel 8, in order to perform rough detection (S33).

The leading surface grinding start position at this time is set to a position at which the leading surface of a new grinding wheel 8 can be detected even when the new grinding wheel 8 with the maximum thickness is mounted. An advancing amount of the grinding wheel 8 from the leading surface detection start position to the advancing end is set within such a range that the equipment is not damaged by the grinding wheel 8, even though the grinding wheel 8 is advanced to the advancing end.

Then, it is determined whether the leading surface of the grinding wheel 8 could be detected through the rough detection S33 (S34). When the leading surface of the grinding wheel 8 could be detected, the grinding wheel spindle 6 is retreated by a preset amount as illustrated in FIG. 9C (S35). While the grinding wheel spindle 6 is advanced through slow-feeding as illustrated in FIG. 9D (S36), the touch sensor 28 of the position detection unit 12 is brought in contact with the leading surface of the grinding wheel 8 in order to perform precise leading surface position detection (S37). Then, it is determined whether a precise leading surface position could be detected (S38).

When the touch sensor 28 was not brought in contact with the leading surface of the grinding wheel 8 and the leading surface of the grinding wheel 8 could not be detected during the rough detection S33 (S34), it is judged whether the number of times that the leading surface of the grinding wheel 8 could not be detected falls within a preset number of times (S39). When the number of times falls within the preset number of times, the grinding wheel spindle 6 is moved (retreated) to the leading surface detection start position (S40) as illustrated in FIG. 9E, changes the measurement location of the grinding wheel 8 by rotating the grinding wheel spindle 6 by a preset phase amount around the axis center (S41), advances the grinding wheel spindle 6 through fast-feeding (S32), roughly detects the leading surface position of the grinding wheel 8 (S33), and determines whether the leading surface position can be detected (S34).

When it is determined at the rough detection S33 that the leading surface position of the grinding wheel 8 cannot be detected (S34), the rough detection operation is repeated (S32 to S34 and S39 to S41) while the grinding wheel spindle 6 is sequentially rotated by the preset phase amount (S41), until the number of times that the leading surface position could not be detected reaches the preset number of times (S39).

When the number of times that the leading surface position could not be detected during the rough detection exceeds the preset number of times (S39), the leading surface detection start position is changed (updated) to a position advanced by a preset amount (S42),because the leading surface detection start position of the grinding wheel spindle 6 is too high. Then, it is determined whether the number of times that the leading surface detection start position is changed falls within a preset number of times (S43). When the number of changes falls within the preset number of times, the grinding wheel spindle 6 is moved to the changed leading surface detection start position (S40), and the rough detection operation is repeated in the same manner as described above (S32 to S34 and S39 to S41), until the number of times that the leading surface position could not be detected reaches the preset number of times (S39).

When the number of times that the leading surface position could not be detected exceeds the preset number of times during the rough detection operation after the leading surface detection start position was changed (S39), the leading surface detection start position is advanced by a preset amount (S42) because the leading surface detection start position of the grinding wheel spindle 6 is still too high. Then, it is determined whether the number of changes (the number of advancing operations) falls within the preset number of times (S43). When the number of changes falls within the preset number of times, the grinding wheel spindle 6 is moved to the changed leading surface detection start position (S40), and the same rough detection operation is repeated (S32 to S34 and S39 to S41) until the number of times that the leading surface position could not be detected reaches the preset number of times (S60).

When the leading surface position of the grinding wheel 8 cannot be detected even in the rough detection operation after the leading surface detection start position was changed, the series of rough detection operations are repeated (S32 to S34 and S39 to S41) whenever the leading surface detection start position is changed, until the number of times that the leading surface detection start position is changed reaches the preset number of times (S43). When the number of changes exceeds the preset number of times (S43), an abnormality is notified, and the rough detection operation is finished (S44). When an abnormality occurred, an appropriate operation, for example, an operation of changing the setting values is performed, and the measuring of the leading surface position is performed again.

When the leading surface position of the grinding wheel 8 cannot be detected through the precise leading surface position detection S37 (S38), it is determined whether the number of times that the leading surface position of the grinding wheel 8 could not be detected falls within the preset number of times (S39). When the number of times that the leading surface position of the grinding wheel 8 could not be detected falls within the preset number of times, the grinding wheel spindle 6 is moved to the leading surface detection start position in the same manner as the rough detection operation (S40), and the grinding wheel spindle 6 by a preset phase amount is rotated to change the measurement location of the grinding wheel 8 (S41), and the detection operation from the rough detection S33 to the precise leading surface position detection S37 is repeated (S32 to S41).

When the number of times that the leading surface position could not be detected by the precise leading surface position detection S37 exceeds a preset number of times (S39), the leading surface detection start position of the grinding wheel spindle 6 is changed (S42 and S43) until the number of changes reaches the preset number of times, and the detection operation is repeated (S32 to S41).

When the leading surface position could be detected through the precise leading surface position detection S37 (S38), it is determined whether the number of detection operations reached a preset number of times (S45). When the number of detection operations falls within the preset number of times, the detection operation from the rough detection S33 to the precise leading surface position detection S37 is repeated through the step S40 of moving the grinding wheel spindle 6 to the leading surface detection start position and the step S41 of rotating the grinding wheel spindle 6 by the preset phase amount (S32 to S38, S40, S41 and S45).

When the number of times that the leading surface position of the grinding wheel 8 was detected through the precise leading surface position detection S37 reached a preset number of times (S45), the thickness of the grinding wheel 8 is calculated through the leading most leading surface position among the leading surface positions acquired through the respective detection operations (S46). Then, the leading surface detection start position is reset to the initial value (initially set position) set at the step S31 (S47). Then, as illustrated in FIG. 9F, the grinding wheel spindle 6 is retreated to the grinding wheel spindle origin point (S48), and the position detection unit 12 is retreated to the housing position E (S49). Then, the measuring of the leading surface position of the grinding wheel 8 is finished.

During the detection operation from the rough detection S33 to the precise leading surface position detection S37, the feeding amount measuring unit 20 measures a feeding amount of the grinding wheel spindle 6 whenever the grinding wheel spindle 6 is advanced/retreated. Thus, when the touch sensor 28 detects the leading surface position of the grinding wheel 8, the measurement value of the feeding amount measuring unit 20 at this time is read and processed as the leading surface position of the grinding wheel 8.

Even when the grinding wheel mounting surface 7 of the grinding wheel spindle 6 is measured, the measuring is performed in the same manner as the measuring of the leading surface position of the grinding wheel 8.

In the present embodiment, the rough detection S33 and the precise leading surface position detection S37 are set to one set, and repeated a preset number of times. However, when the rough detection S33 is performed once, the rough detection S33 and the precise leading surface position detection S37 may be separated, and the precise leading surface position detection S37 may be repeated a preset number of times (a plurality of times).

In general, while the leading surface detection start position is advanced by a preset amount for each operation, the rough detection S33 and/or the precise leading surface position detection S37 are performed. However, the fast-feeding amount may be increased to perform the rough detection S33 and/or the precise leading surface position detection S37, without changing the leading surface detection start position.

The reason to repeat the detection operation the plurality of times while changing the position of the grinding wheel 8 in the rotation direction is in order to consider the influence of vibration on the leading-side end surface of the grinding wheel 8. When the grinding wheel 8 having the plurality of segments 8*a* provided in a ring shape is used, the touch sensor 28 may not come in contact with the grinding wheel 8 during measurement at a certain location, in the case where a segment 8*a* is lost or a large gap is provided between the segments 8*a*. Therefore, by repeating the detection operation the plurality of times while changing the position in the circumferential direction, it is possible to remove a problem caused by a loss of a segment or the like.

In the surface grinding machine, when the self grinding wheel 8A is mounted on the grinding wheel spindle 6 in order to perform self grinding on the chuck surface 18 of the chuck table 3, the reference distance G is calculated by the reference distance calculation unit 42.

During the operation of calculating the reference distance G, the grinding wheel mounting surface position J of the grinding wheel spindle 6 is first acquired. That is, the position detection unit 12 is turned to the detection position F, and the grinding wheel spindle 6 is advanced from the origin position O by a manual operation or an automatic operation. Furthermore, when the advancing of the grinding wheel spindle 6 is started, the feeding amount measuring unit 20 measures a feeding amount from the origin position O of the grinding wheel spindle 6. When the touch sensor 28 of the position detection unit 12 is brought in contact with the grinding wheel mounting surface 7 of the grinding wheel spindle 6, the measurement value of the feeding amount measuring unit 20 at this time is acquired as the grinding wheel mounting surface position J by the reference distance calculation unit 42.

After the self grinding wheel 8A is mounted on the grinding wheel mounting surface 7 of the grinding wheel spindle 6, the grinding wheel spindle 6 is advanced from a self grinding start position K under the origin position O by a manual operation or automatic operation while the grinding wheel spindle 6 and the chuck table 3 are rotated in a predetermined direction, so as to perform a self grinding on the chuck surface of the chuck table 3 by the self grinding wheel 8A.

When the self grinding on the chuck surface 18 is finished, the reference distance calculation unit 42 acquires the measurement value of the feeding amount measuring unit 20 till the self grinding finish time as a self grinding finish position L. The finish of the self grinding is determined in the manual operation or the automatic operation.

When the self grinding finish position L is determined, the reference distance calculation unit 42 can calculate a self grinding feeding amount of the grinding wheel spindle 6 by subtracting the measurement value of the self grinding finish position L from the known self grinding start position K.

When the self grinding is finished, the position detection unit 12 is turned to the detection position F, in order to measure the leading surface position of the self grinding wheel 8A after the finish of the self grinding. The measuring of the leading surface position is performed in the same manner as the measuring of the grinding wheel mounting surface position J of the grinding wheel spindle 6. That is, the measurement value of the feeding amount measuring unit 20 at the point of time that the touch sensor 28 of the position detection unit 12 detected the leading surface of the self grinding wheel 8A is acquired as the leading surface position of the self grinding wheel 8A.

Figure 5:
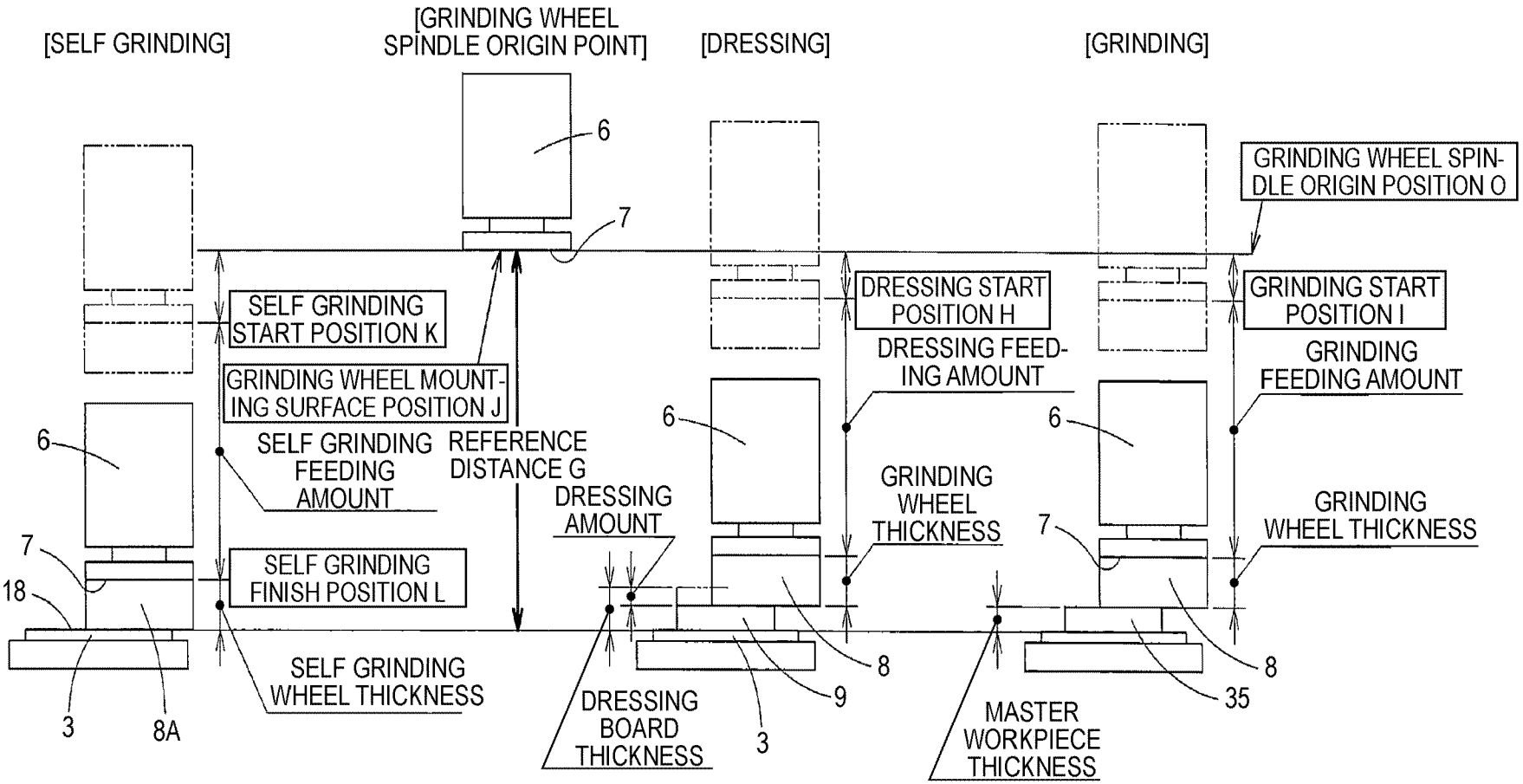
FIG. 5 is an explanatory drawing for describing self grinding, dressing and grinding operations of the surface grinding machine.

When the leading surface position of the self grinding wheel 8A is determined, the reference distance calculation unit 42 can calculate the thickness of the self grinding wheel 8A from a difference between the leading surface position of the self grinding wheel 8A and the grinding wheel mounting surface position J of the grinding wheel spindle 6 (refer to [self grinding] of FIG. 5).

Therefore, the reference distance calculation unit 42 can calculate the reference distance G from the origin position O of the grinding wheel mounting surface 7 of the grinding wheel spindle 6 to the chuck surface 18 of the chuck table 3 by adding up the known feeding amount from the grinding wheel mounting surface 7 of the grinding wheel spindle 6 at the origin position O to the self grinding start position K, the self grinding feeding amount from the self grinding start position K to the self grinding finish position L, and the thickness of the self grinding wheel 8A (refer to [grinding wheel spindle origin point] of FIG. 5).

When the dressing start position H is calculated by the dressing start position calculation unit 43, the position detection unit 12 is turned to the detection position F, in order to acquire the leading surface position of the grinding wheel 8 at the origin position O. At this time, the measurement value of the feeding amount measuring unit 20 at the point of time that the touch sensor 28 of the position detection unit 12 was brought in contact with the top of the grinding wheel 8 is acquired as the leading surface position of the grinding wheel 8 by the dressing start position calculation unit 43. When the leading surface position of the grinding wheel 8 is determined, the dressing start position calculation unit 43 can calculate the thickness of the grinding wheel 8 using the leading surface position of the grinding wheel 8 and the acquired grinding wheel mounting surface position J.

The thickness of the dressing board 9 is measured by the height measuring unit 11. When the dressing board thickness is determined, the dressing start position calculation unit 43 can calculate the dressing start position H based on the reference distance G, the dressing board thickness, a predetermined dressing feeding amount and the thickness of the grinding wheel 8. The dressing start position calculation unit 43 can calculate the dressing start position H by subtracting the dressing board thickness before dressing, the predetermined dressing feeding amount and the grinding wheel thickness before dressing from the reference distance G (refer to [dressing] of FIG. 5).

As such, the dressing start position calculation unit 43 can calculate the dressing start position H by subtracting the dressing board thickness before dressing, the grinding wheel thickness and the predetermined dressing feeding amount from the reference distance G. This is in order to prevent the equipment from being damaged by the leading surface of the grinding wheel 8 during dressing. The dressing feeding amount includes a dressing amount by wear of the dressing board 9 and the grinding wheel 8.

When the grinding start position I is calculated by the grinding start position calculation unit 44, the leading surface position of the grinding wheel 8 mounted on the grinding wheel mounting surface 7 of the grinding wheel spindle 6 is acquired by the position detection unit 12 and the feeding amount measuring unit 20. When the thickness of the master workpiece 35 or the finish thickness of the workpiece and the grinding feeding amount are set, the grinding start position calculation unit 44 can calculate the grinding start position I at which the grinding wheel mounting surface 7 of the grinding wheel spindle 6 is positioned at the start of grinding, by subtracting the thickness of the master workpiece 35 or the finish thickness of the workpiece, the grinding feeding amount and the thickness of the grinding wheel 8 from the reference distance G (refer to [grinding] of FIG. 5).

Figure 11:
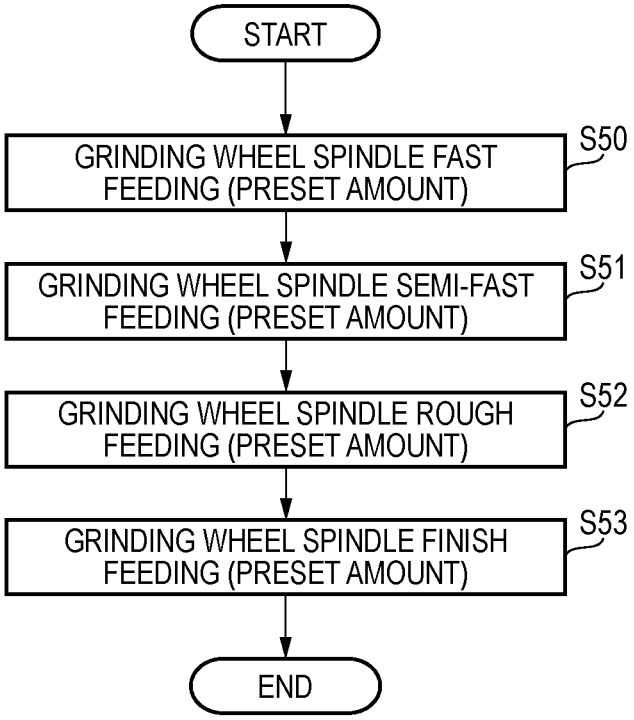
FIG. 11 is a flowchart illustrating a normal dressing cycle.

The operation of dressing the grinding wheel 8 is performed by a load sensing dressing cycle. As illustrated in FIG. 11, a normal dressing cycle is performed by advancing the grinding wheel spindle 6 from the dressing start position H while sequentially reducing the feeding speed in order of fast feeding (S50), semi-fast feeding (S51), rough feeding (S52) and finish feeding (S53) for a predetermined feeding amount and feeding speed.

Figure 12B:
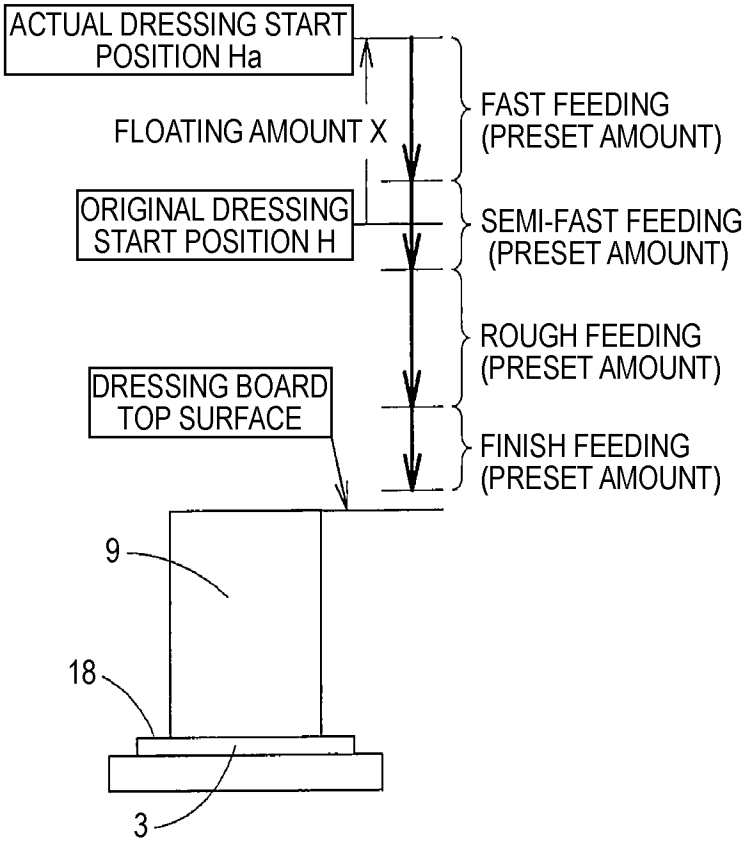
FIGS. 12A and 12B are explanatory drawings for describing the normal dressing cycle.
Figure 12A:
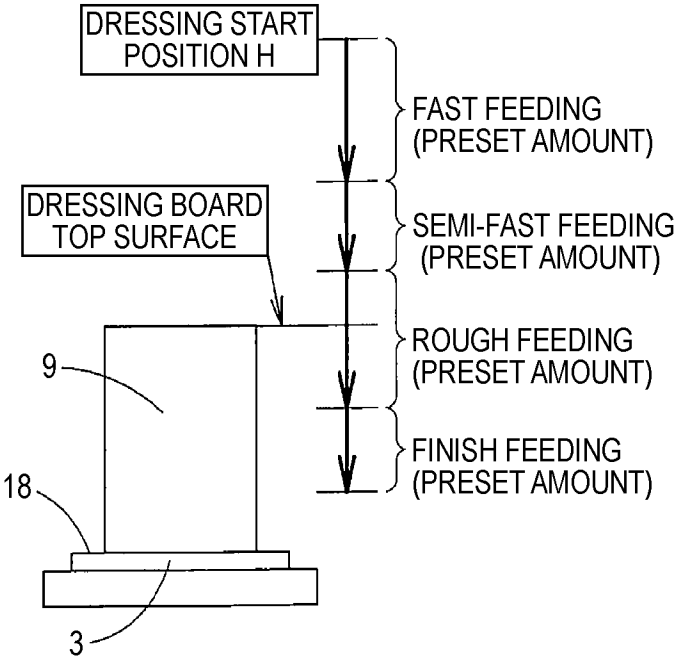

The feeding amount of the grinding wheel 8 is set in such a manner that the grinding wheel 8 and the dressing board 9 are brought in contact with each other during the rough feeding as illustrated in FIG. 12A. However, since the dressing grinding stone part 15 is attached to the sheet member 14 attached to the dicing frame 26, the dressing board 9 may float from the dressing board placing table 10 when the sheet member 14 or the dressing grinding stone part 15 is incompletely attached. Then, during the operation of detecting the thickness of the dressing board 9, the dressing start position H higher than the actual thickness of the dressing board 9 may be calculated.

In this case, as illustrated in FIGS. 12A and 12B, the actual dressing start position Ha may be set to a position higher by a floating amount X than the original dressing start position H. Thus, in the dressing cycle, the grinding wheel or equipment may not be damaged even though the grinding wheel 8 and the dressing board 9 are brought in excessive contact with each other. However, the grinding wheel 8 and the dressing board 9 may be brought in contact with each other during the rough feeding, brought in contact with each other during the finish feeding, or not be brought in contact with each other even though the finish feeding is completed. Therefore, in the normal cycle in which a predetermined amount of cutting is performed from the dressing start position Ha, dressing may be incompletely performed by under cutting.

Figure 13:
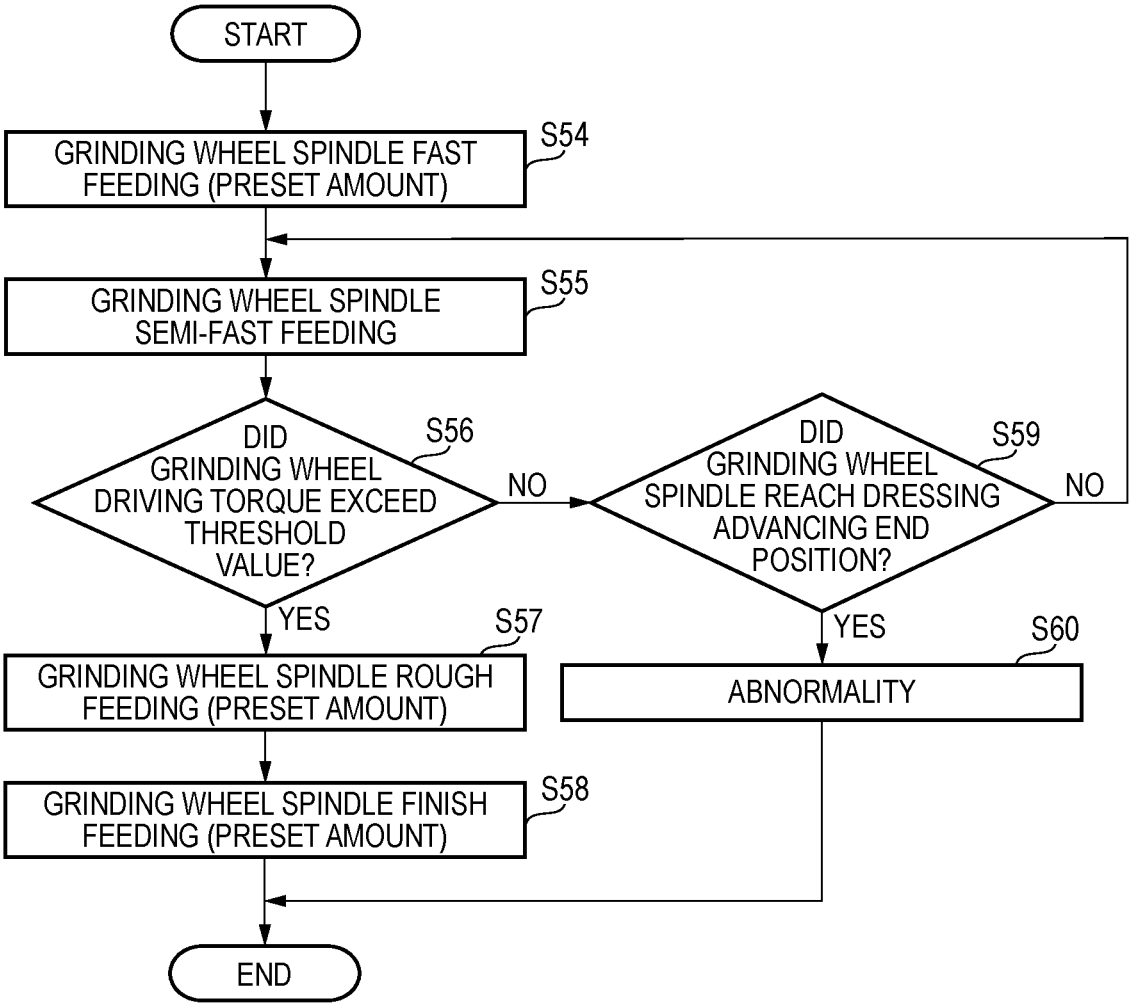
FIG. 13 is a flowchart illustrating a load sensing dressing cycle.

The adoption of the load sensing dressing cycle can remove the problem of the conventional normal dressing cycle. Even in the load sensing dressing cycle, the grinding wheel spindle 6 is advanced from the dressing start position H through fast feeding at a preset feeding amount and speed (S54) as illustrated in FIGS. 13 and 14A. When the grinding wheel spindle 6 is advanced by a preset amount through the fast feeding, the fast feeding is switched to semi-fast feeding, and the grinding wheel spindle 6 is advanced (S55).

At this time, a feeding amount is not set to the semi-fast feeding of the grinding wheel spindle 6, and whether a driving torque detected by the load sensing unit 45 exceeds a threshold value is always monitored during the semi-fast feeding (S56). When the grinding wheel 8 and the dressing board 9 are brought in contact with each other such that the driving torque of the grinding wheel 8 exceeds the threshold value, the feeding speed of the grinding wheel spindle 6 is lowered from this point of time, and the grinding wheel spindle 6 is roughly fed at preset feeding amount and speed (S58). Then, the dressing board 9 dresses the grinding wheel 8 by a preset amount, and the load sensing dressing cycle is finished.

When the driving torque does not exceed the threshold value, it is determined whether the grinding wheel spindle 6 reached the dressing advancing end position (S59). When the grinding wheel spindle 6 does not reach a dressing advancing end position, the semi-fast feeding of the grinding wheel spindle 6 is continued (S55). On the other hand, when the driving torque does not exceed the threshold value but the grinding wheel spindle 6 reached the dressing advancing end position, an abnormality is notified and the load sensing dressing cycle is finished (S60).

Figure 14B:
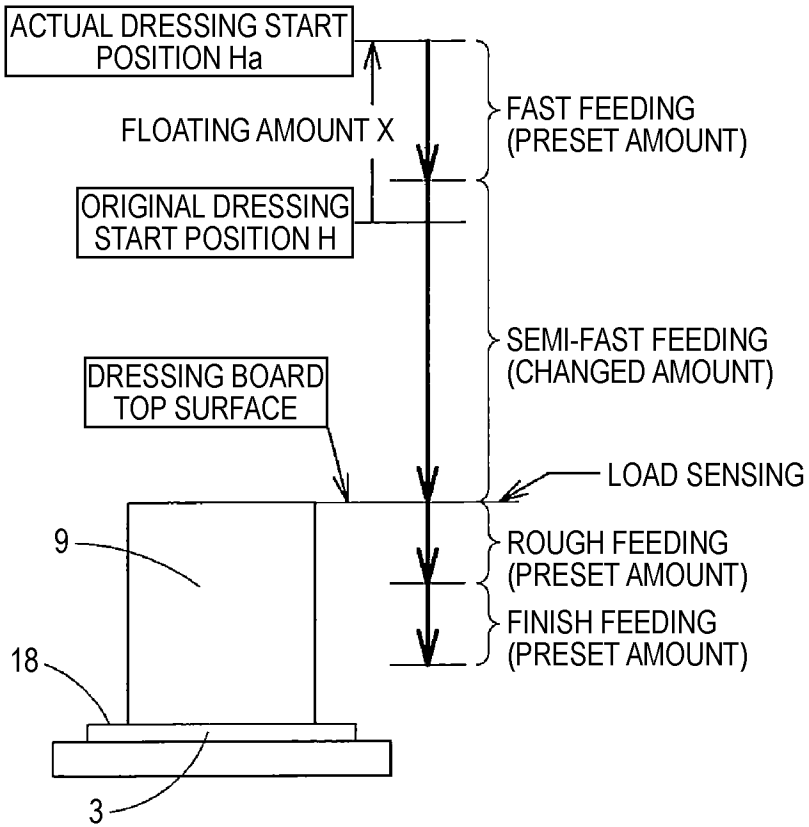
FIGS. 14A and 14B are explanatory drawings for describing the load sensing dressing cycle.
Figure 14A:
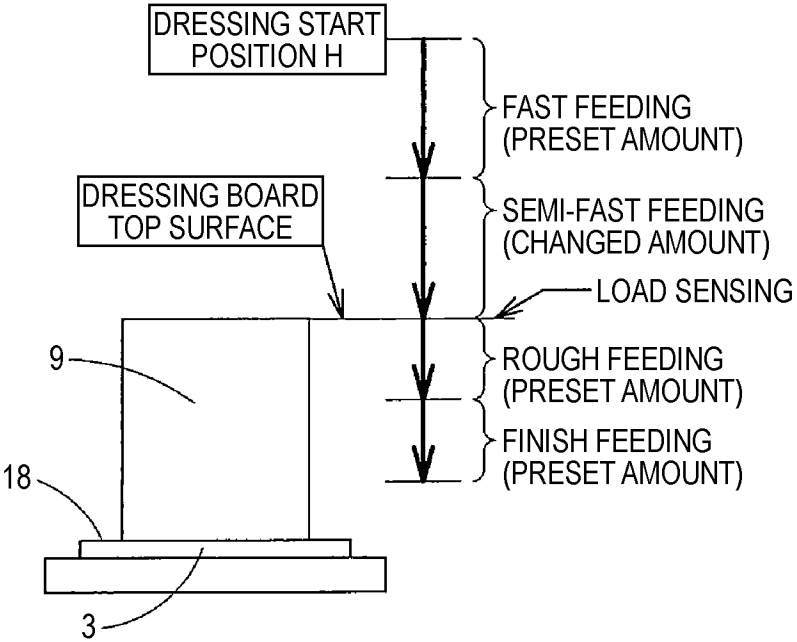

When the load sensing dressing cycle is used, an insufficient dressing of the grinding wheel 8 does not occur unlike the normal dressing cycle, but the grinding wheel 8 can be reliably dressed, even though the actual dressing start position Ha is higher than the original dressing start position H due to the floating of the dressing board 9 as illustrated in FIG. 14B, compared to normal times that the dressing board does not float as illustrated in FIG. 14A.

Therefore, in the load sensing dressing cycle, the dressing cycle is started from separated positions at which the grinding wheel 8 and the dressing board 9 are unlikely to come in contact with each other, even though the position detection unit 12 and the height measuring unit 11 are not used. Thus, the grinding wheel 8 can be precisely dressed with the dressing board 9.

However, an air cut amount is increased as much, and quite a long time is required until the dressing of the grinding wheel 8 is completed. Although the air cut amount would be reduced and a precise dressing can be done if the dressing position-adjustment is performed by an operator as usual, a workload of the operator is inevitably increased.

Accordingly, when the grinding wheel 8 is dressed with the dressing board 9, the load sensing dressing cycle can be adopted to reliably dress the grinding wheel 8. Moreover, the dressing can be performed in a short time without a loss.

Figure 15:
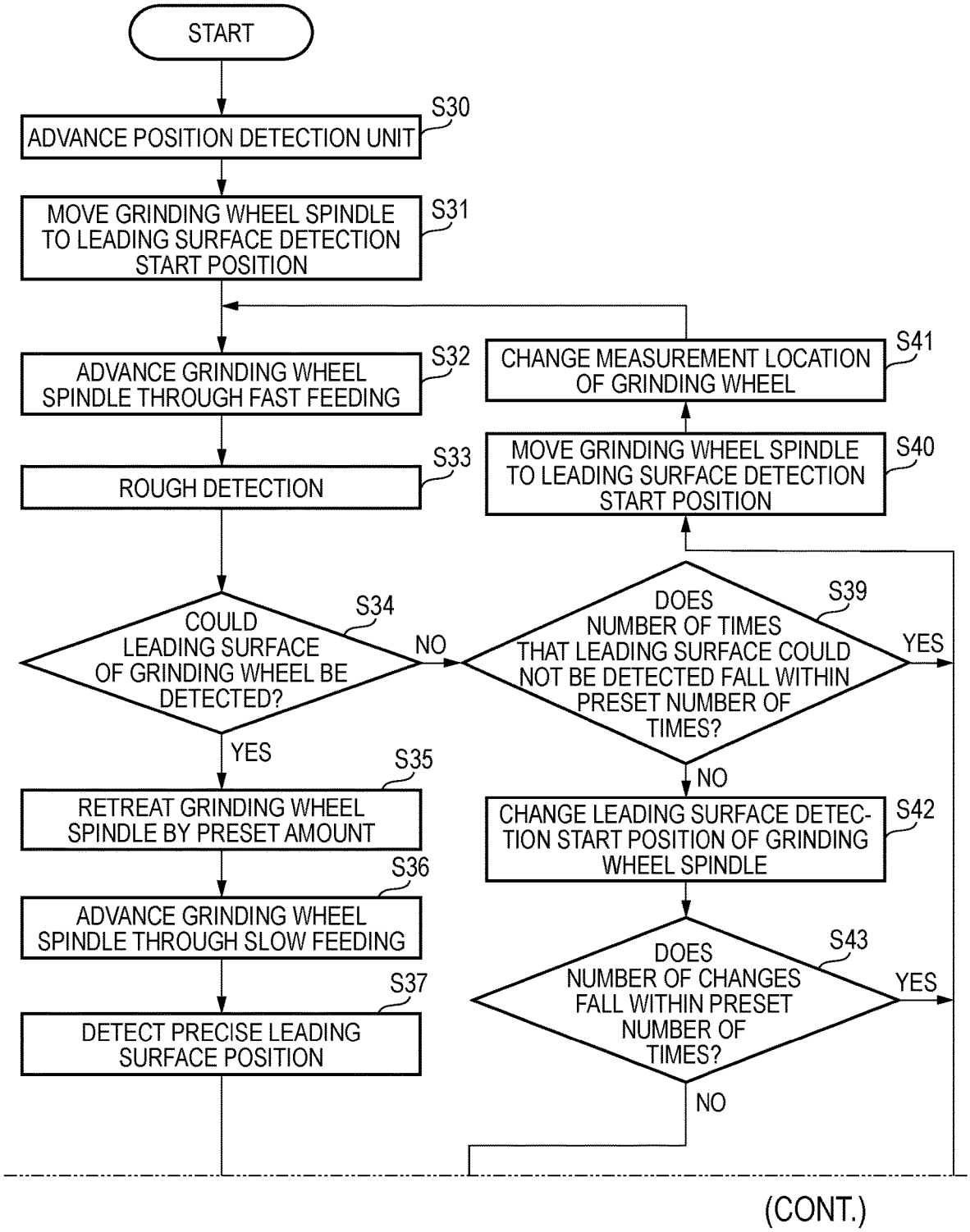
FIG. 15 is a flowchart illustrating leading surface position detection according to a second embodiment.

FIG. 15 illustrates a second embodiment. In the second embodiment, when the leading surface position of the grinding wheel 8 could not be detected through the precise leading surface position detection S37, the detection operation is repeated without changing the leading surface detection start position.

That is, when the leading surface position of the grinding wheel 8 could not be detected through the precise leading surface position detection S37, it is determined whether the number of times that the leading surface position of the grinding wheel 8 could not be detected falls within a preset number of times (S39-2). When the number of times that the leading surface position of the grinding wheel 8 could not be detected falls within the preset number of times, the grinding wheel spindle 6 is moved to the changed leading surface detection start position (S40), and the measurement location of the grinding wheel 8 is changed by rotating the grinding wheel spindle 6 by a preset phase amount (S41), and the detection operation from the rough detection S33 to the precise leading surface position detection S37 is repeated (S32 to S38, S39-2, S40 and S41).

In the second embodiment, the procedure proceeds to step S40 without going through step S42 of changing the leading surface detection start position to the advanced position in FIG. 10. Therefore, the detection operation from the rough detection S33 to the precise leading surface position detection S37 is repeated without changing the leading surface detection start position.

When the rough detection S33 can be performed but the precise leading surface position detection S37 cannot be performed, it may indicate that a preset value of the slow feeding amount of the grinding wheel spindle 6 is too small. Therefore, when the rough detection S33 can be performed but the precise leading surface position detection S37 cannot be performed, the preset value of the slow feeding amount of the grinding wheel spindle 6 may be increased afterwards, or set to a large value in advance. Then, the precise leading surface position detection S37 can be performed without changing the leading surface detection start position.

The number of times that the leading surface position of the grinding wheel 8 could not be detected may be set to the total number of cases in which the leading surface position of the grinding wheel 8 could not be detected or the number of consecutive cases in which the leading surface position of the grinding wheel 8 could not be detected. For example, when the leading surface position of the grinding wheel 8 is detected while changing the phase by rotating the grinding wheel spindle 6 by a predetermined angle, the number of times may be set to the total number of cases in which the leading surface position of the grinding wheel 8 could not be detected. When the number of times is set to the number of consecutive cases in which the leading surface position of the grinding wheel 8 could not be detected, the counting value can be cleared in the case where the leading surface position of the grinding wheel 8 can be detected.

In the precise leading surface position detection S37 within the preset number of times, when the leading surface position of the grinding wheel 8 cannot be detected and the number of times that the leading surface position of the grinding wheel 8 could not be detected exceeds the preset number of times (S39-2), an abnormality is notified, and the procedure is finished (S44).

Although embodiments have been described in detail in the above, the present invention is not limited to the embodiments, but can be modified in various manners. For example, in the embodiments, the ultra-precision vertical surface grinding machine has been exemplified. However, other surface grinding machines can be applied in the same manner.

In the embodiments, a contact-type displacement sensor is used in the position detection unit 12 and the height measuring unit 11, but a non-contact-type displacement sensor and other sensors can also be employed. The position detection unit 12 and the height measuring unit 11 employ a turning mechanism as a moving mechanism for movably supporting a sensor. However, a linearly moving mechanism and other moving mechanism can be employed between the measurement position C and the retreat position D and between the housing position E and the detection position F.

Furthermore, during the detection operation for detecting the leading surface position of the grinding wheel 8 through the position detection unit 12, the leading surface detection start position is advanced by the preset amount as a process when the leading surface position is not detected, and the abnormality determination is determined according to the number of advancing operations. However, the abnormality determination may be performed according to the total advancing amount.

The dressing board 9 according to the embodiments includes the ring-shaped dicing frame 26, the sheet member 14 bonded to the lower side of the dicing frame 26, and the dressing grinding stone part 15 concentrically bonded on the sheet member 14 with a predetermined distance provided between the dressing grinding stone part 15 and the dicing frame 26. However, the dressing grinding stone part 15 may be bonded to the sheet member 14 made of resin or metal, as long as the dressing grinding stone part 15 can be suctioned to the chuck table 3 and loaded/unloaded by the loader 13. The sheet member 14 may be formed in a proper shape such as a circular shape or rectangular shape, if necessary.

In the load sensing dressing cycle, when the grinding wheel spindle 6 is driven by the driving motor such as a servo motor, a change of the torque value of the driving motor is generally sensed as a load. However, a change in power value or current value of the driving motor may be used, and other load sensing units such as an AE sensor, strain gauge and piezoelectric element may be used. In short, any sensing units may be used as long as they can sense a contact between the grinding wheel 8 and the dressing board 9. Furthermore, the load sensing dressing cycle is employed as the dressing cycle of the grinding wheel 8 with the dressing board 9, but a normal dressing cycle may be employed.

When other tools are used, the process from the self grinding to the workpiece grinding needs to be performed for each of the tools.

In accordance with embodiments, in a surface grinding method in which a grinding wheel is dressed with a dressing board on a chuck table by advancing the grinding wheel from a dressing start position and a workpiece on the chuck table is ground by advancing the grinding wheel, the dressing start position is calculated by measuring a thickness of the dressing board and a thickness of the grinding wheel, and the grinding start position is calculated by measuring the thickness of the grinding wheel after the dressing of the grinding wheel with the dressing board.

According to the method, the surface grinding method can efficiently dress the grinding wheel through the dressing board, and automatically calculate the dressing start position and the grinding start position.

In accordance with the embodiments, in the surface grinding method, in the calculating the dressing start position, the dressing start position may be calculated based on the thickness of the grinding wheel, the thickness of the dressing board and a dressing feeding amount. In the calculating the grinding start position, the grinding start position may be calculated based on the thickness of the grinding wheel, the finish thickness of the workpiece and a grinding feeding amount.

In accordance with the embodiments, in the surface grinding method, the thickness of the grinding wheel may be calculated based on a leading surface position of the grinding wheel and a grinding wheel mounting surface position of a grinding wheel spindle.

In accordance with the embodiments, in the surface grinding method, the dressing start position and the grinding start position may be automatically updated after a dressing cycle of the grinding wheel is finished and the leading surface position of the grinding wheel is measured.

In accordance with the embodiments, in the surface grinding method, a reference distance between a chuck surface of the chuck table and the grinding wheel mounting surface of the grinding wheel spindle at an origin position may be calculated after the chuck surface is self-ground. The dressing start position and the grinding start position may be calculated based on the reference distance.

In accordance with the embodiments, in the surface grinding method, the leading surface position of the grinding wheel or the grinding wheel mounting surface position may be calculated from a feeding amount of the grinding wheel spindle when the grinding wheel spindle is advanced and a position detection unit detects the leading surface of the grinding wheel or the grinding wheel mounting surface.

In accordance with the embodiments, in the surface grinding method, the thickness of the dressing board may be measured from a height of a top surface of a dressing board placing table and a height of a top surface of the dressing board on the dressing board placing table.

In accordance with the embodiments, in the surface grinding method, the grinding wheel may be fed by a preset amount from a point that a rotation load of the grinding wheel increases when the grinding wheel is dressed.

In accordance with embodiments, in a surface grinding machine, a grinding wheel mounted on a grinding wheel mounting surface of a grinding wheel spindle is dressed with a dressing board on a chuck table by advancing the grinding wheel from a dressing start position, and a workpiece on the chuck table is ground by advancing the grinding wheel from a grinding start position. The surface grinding machine includes: a dressing board placing table on which the dressing board is placed; a height measuring unit configured to measure a height of a top surface of the dressing board placing table and a height of a top surface of the dressing board on the dressing board placing table; a position detection unit configured to detect a position of the grinding wheel mounting surface and a position of a leading surface of the grinding wheel; a dressing start position calculation unit configured to calculate the dressing start position based on the height of the top surface of the dressing board placing table and the height of the top surface of the dressing board; and a grinding start position calculation unit configured to calculate the grinding start position based on the position of the grinding wheel mounting surface and the position of the leading surface of the grinding wheel.

According to the embodiment, the surface grinding machine can efficiently dress the grinding wheel through the dressing board, and automatically calculate the dressing start position and the grinding start position.

What is claimed is:

1. A surface grinding method, the method comprising:

dressing a grinding wheel with a dressing board on a chuck table by advancing the grinding wheel from a dressing start position;

grinding a workpiece on the chuck table by advancing the grinding wheel after the dressing of the grinding wheel with the dressing board;

calculating the dressing start position by measuring a thickness of the dressing board and a thickness of the grinding wheel; and calculating the grinding start position by measuring the thickness of the grinding wheel after the dressing of the grinding wheel with the dressing board.

2. The surface grinding method according to claim 1, wherein in the calculating the dressing start position, the dressing start position is calculated based on the thickness of the grinding wheel, the thickness of the dressing board and a dressing feeding amount, and in the calculating the grinding start position, the grinding start position is calculated based on the thickness of the grinding wheel, the finish thickness of the workpiece and a grinding feeding amount.

3. The surface grinding method according to claim 1, wherein the thickness of the grinding wheel is calculated based on a leading surface position of the grinding wheel and a grinding wheel mounting surface position of a grinding wheel spindle.

4. The surface grinding method according to claim 1, wherein the dressing start position and the grinding start position are automatically updated after a dressing cycle of the grinding wheel is finished and the leading surface position of the grinding wheel is measured.

5. The surface grinding method according to claim 1, wherein a reference distance between a chuck surface of the chuck table and the grinding wheel mounting surface of the grinding wheel spindle at an origin position is calculated after the chuck surface is self-ground, and the dressing start position and the grinding start position are calculated based on the reference distance.

6. The surface grinding method according to claim 1, wherein the leading surface position of the grinding wheel or the grinding wheel mounting surface position is calculated from a feeding amount of the grinding wheel spindle when the grinding wheel spindle is advanced and a position detection unit detects the leading surface of the grinding wheel or the grinding wheel mounting surface.

7. The surface grinding method according to claim 1, wherein the thickness of the dressing board is measured from a height of a top surface of a dressing board placing table and a height of a top surface of the dressing board on the dressing board placing table.

8. The surface grinding method according to claim 1, wherein the grinding wheel is fed by a preset amount from a point that a rotation load of the grinding wheel increases when the grinding wheel is dressed.

9. A surface grinding machine in which a grinding wheel mounted on a grinding wheel mounting surface of a grinding wheel spindle is dressed with a dressing board on a chuck table by advancing the grinding wheel from a dressing start position, and a workpiece on the chuck table is ground by advancing the grinding wheel from a grinding start position, the surface grinding machine comprising:

a dressing board placing table on which the dressing board is placed;

a height measuring unit configured to measure a height of a top surface of the dressing board placing table and a height of a top surface of the dressing board on the dressing board placing table;

a position detection unit configured to detect a position of the grinding wheel mounting surface and a position of a leading surface of the grinding wheel;

a dressing start position calculation unit configured to calculate the dressing start position based on the height of the top surface of the dressing board placing table and the height of the top surface of the dressing board; and a grinding start position calculation unit configured to calculate the grinding start position based on the position of the grinding wheel mounting surface and the position of the leading surface of the grinding wheel.

* * * * *